US010542588B2

(12) United States Patent
Aritaki et al.

(10) Patent No.: US 10,542,588 B2
(45) Date of Patent: Jan. 21, 2020

(54) HEATER WITH ELONGATED HEATING RESISTOR LAYER

(71) Applicant: ROHM CO., LTD., Kyoto-shi, Kyoto (JP)

(72) Inventors: Yasuyuki Aritaki, Kyoto (JP); Masashi Takagi, Kyoto (JP)

(73) Assignee: ROHM CO., LTD., Kyoto (JP)

( * ) Notice: Subject to any disclaimer, the term of this patent is extended or adjusted under 35 U.S.C. 154(b) by 597 days.

(21) Appl. No.: 15/197,197

(22) Filed: Jun. 29, 2016

(65) Prior Publication Data

US 2017/0013676 A1 Jan. 12, 2017

(30) Foreign Application Priority Data

Jun. 30, 2015 (JP) ..... 2015-131372
Jun. 30, 2015 (JP) ..... 2015-131373
Jun. 23, 2016 (JP) ..... 2016-124140

(51) Int. Cl.
*H05B 3/26* (2006.01)
*G03G 15/20* (2006.01)
(Continued)

(52) U.S. Cl.
CPC ..... *H05B 3/265* (2013.01); *G03G 15/2053* (2013.01); *H05B 1/0241* (2013.01);
(Continued)

(58) Field of Classification Search
CPC . H05B 3/265; H05B 3/28; H05B 3/26; H05B 3/22; H05B 3/20; H05B 3/16;
(Continued)

(56) References Cited

U.S. PATENT DOCUMENTS 8,126,383 B2 * 2/2012 Kagawa ..... G03G 15/2042 399/329
2009/0245900 A1 10/2009 Kagawa

FOREIGN PATENT DOCUMENTS

CN 101551630 A 10/2009
JP 2008107761 A 5/2008
JP 2009-193844 A 8/2009

OTHER PUBLICATIONS

Office Action received in the corresponding Chinese Patent application, dated Oct. 25, 2018, and corresponding machine translation (17 pages).

* cited by examiner

*Primary Examiner* — Shawntina T Fuqua
(74) *Attorney, Agent, or Firm* — Hamre, Schumann, Mueller & Larson, P.C.

(57) ABSTRACT

A heater includes a substrate, a heating resistor layer, and an electrode layer. The substrate has a substrate obverse surface and a substrate reverse surface. The heating resistor layer is formed on the substrate obverse surface. The electrode layer is formed on the substrate obverse surface and in contact with the heating resistor layer. The electrode layer includes a pair of strip portions extending in a longitudinal direction of the substrate and spaced apart from each other in the width direction of the substrate. The heating resistor layer includes a main heating member and a sub heating member each extending in the longitudinal direction of the substrate and located between the strip portions in the width direction. The sub heating member has a higher temperature coefficient of resistance than that of the main heating member.

31 Claims, 20 Drawing Sheets

(51) Int. Cl.
*H05B 1/02* (2006.01)
*H05B 3/03* (2006.01)

(52) U.S. Cl.
CPC ..... *H05B 3/03* (2013.01); *H05B 2203/005* (2013.01); *H05B 2203/007* (2013.01); *H05B 2203/011* (2013.01)

(58) Field of Classification Search
CPC ..... H05B 2203/005; H05B 2203/007; H05B 2203/009; H05B 2203/01; H05B 2203/011; H05B 2203/013; H05B 2203/037; H05B 3/03; H05B 3/10; H05B 1/0241; H05B 1/0214; G05G 15/2053; G05G 15/2042; G03G 2215/2029; G03G 2215/2038; G03G 2215/2035
See application file for complete search history.

HEATER WITH ELONGATED HEATING RESISTOR LAYER

BACKGROUND OF THE INVENTION

1. Field of the Invention

The present invention relates to a heater with an elongated heating resistor layer.

2. Description of the Related Art

In existing electronic apparatuses such as a copier, a facsimile machine, a printer, and the like, a heater is employed to fix toner. A heater of this type is disclosed, for example, in JP-A-No. 2009-193844. Generally, a toner-fixing heater includes a substrate and a heat layer formed on the substrate. The heat layer has an elongate shape extending in a width direction perpendicular to the transport direction of a printing medium (e.g., a paper sheet) to be heated. The width of the heat layer is determined on the basis of the maximum width of the printing medium to be used. When a narrow printing medium is used on such an elongate heater, end portions of the heat layer do not come into contact with the printing medium. Therefore, the temperature of the end portions of the heater tends to become higher, which leads to wasteful consumption of power.

SUMMARY OF THE INVENTION

The present invention has been proposed in view of the foregoing situations. It is therefore an object of the invention to provide a heater that suppresses excessive temperature rise on end portions of the heater on both sides in a width direction when a relatively narrow printing medium is to be heated.

In an aspect, the present invention provides a heater including an elongate substrate having an obverse surface and a reverse surface, a heating resistor layer formed on the substrate obverse surface, and an electrode layer formed on the substrate obverse surface and in contact with the heating resistor layer. The electrode layer includes a first strip-shaped portion and a second strip-shaped portion extending in a longitudinal direction of the substrate and spaced apart from each other in the width direction of the substrate. The heating resistor layer includes at least a first main heating member and a first sub heating member, each extending in the longitudinal direction and located between the first strip-shaped portion and the second strip-shaped portion in the width direction. The first sub heating member has a higher temperature coefficient of resistance than a temperature coefficient of resistance of the first main heating member.

Preferably, the first main heating member may have a resistance in the width direction that is higher at a reference temperature than a resistance of the first sub heating member in the width direction.

Preferably, the first main heating member may have a sheet resistance that is higher at the reference temperature than a sheet resistance of the first sub heating member.

Preferably, the heating resistor layer may further include a second sub heating member. The first main heating member may be located between the first sub heating member and the second sub heating member in the width direction.

Preferably, the first sub heating member and the second strip-shaped portion may each have a first end portion and a second end portion spaced apart from each other in the width direction. The first end portion of the first sub heating member may be located on the first strip-shaped portion, and the first end portion of the second sub heating member may be located on the second strip-shaped portion.

Preferably, the second end portion of the first sub heating member and the second end portion of the second sub heating member may be located on the first main heating member.

Preferably, the heating resistor layer may further include a second main heating member. The first sub heating member may be located between the first main heating member and the second main heating member, in the width direction.

Preferably, the first main heating member and the second main heating member may each include a first end portion and a second end portion spaced apart from each other in the width direction. The first end portion of the first main heating member may be located on the first strip-shaped portion, and the first end portion of the second main heating member may be located on the second strip-shaped portion.

Preferably, the second end portion of the first main heating member and the second end portion of the second main heating member may be located on the first sub heating member.

Preferably, the first main heating member and the first sub heating member may be partially in contact with each other, in the width direction.

Preferably, the first main heating member may include an end portion located on the first strip-shaped portion.

Preferably, the first sub heating member may include an end portion located on the second strip-shaped portion.

Preferably, the first main heating member may be smaller in size in the width direction than the first strip-shaped portion and the second strip-shaped portion.

Preferably, the first sub heating member may be smaller in size in the width direction than the first strip-shaped portion and the second strip-shaped portion.

Preferably, the heating resistor layer may be greater in size in the width direction than the first strip-shaped portion and the second strip-shaped portion.

Preferably, the electrode layer may be formed directly on the substrate obverse surface.

Preferably, the heating resistor layer may be formed directly on the substrate obverse surface.

Preferably, the heating resistor layer may contain ruthenium oxide.

Preferably, the heating resistor layer may contain copper oxide.

Preferably, the heater may further include a protection layer that at least partially covers the heating resistor layer and the electrode layer.

Preferably, the protection layer may be made of glass.

Preferably, the protection layer may cover an entirety of the heating resistor layer.

Preferably, the electrode layer may include a first pad and a second pad that are connected to the first strip-shaped portion and the second strip-shaped portion, respectively. The first pad and the second pad may be exposed from the protection layer.

Preferably, the first pad and the second pad may be spaced apart from each other in the longitudinal direction, with the first strip-shaped portion and the second strip-shaped portion interposed therebetween.

Preferably, the first pad and the second pad may be located on the same side of the first strip-shaped portion and the second strip-shaped portion respectively in the longitudinal direction.

Preferably, the heater may further include a thermistor provided on the substrate reverse surface.

Preferably, the substrate may be made of a ceramic.

Preferably, the ceramic may include alumina or aluminum nitride.

Preferably, the substrate may have a thickness of 0.4 to 1.2 mm.

Preferably, the electrode layer may contain Ag.

Preferably, a temperature coefficient of resistance of the first sub heating member may be no smaller than three times and no greater than fifteen times a temperature coefficient of resistance of the first main heating member.

Preferably, the first main heating member and the first sub heating member may have a length of 290 mm to 310 mm in the longitudinal direction.

With foregoing configurations, the heating resistor layer includes the main heating member and the sub heating member which are different from each other in temperature coefficient of resistance. By causing the sub heating member to have a higher temperature coefficient of resistance, the sheet resistance increases at a higher rate with temperature rise. Accordingly, when the temperature of a non-passing section, where the printing medium does not pass, becomes higher than the temperature in a sheet passing section, the sheet resistance of the sub heating member increases more in the non-passing section compared with the sheet passing section. Therefore, the current supplied to the heating resistor layer from the electrode layer tends to circumvent the non-passing section and instead concentrate in the sheet passing section. The mentioned configuration contributes to suppressing the heat generation in the portion of the heating resistor layer corresponding to the non-passing section (in particular, of the main heating member), thereby suppressing excessive temperature rise in the non-passing section.

Other features and advantages of the present invention will become more apparent through detailed description given hereunder with reference to the accompanying drawings.

DETAILED DESCRIPTION OF THE PREFERRED EMBODIMENTS

Preferred embodiments according to certain aspects of the present invention will be described below with reference to the accompanying drawings. Referring first to FIG. 1 to FIG. 15, an embodiment according to a first aspect of the invention will be described.

Figure 1:
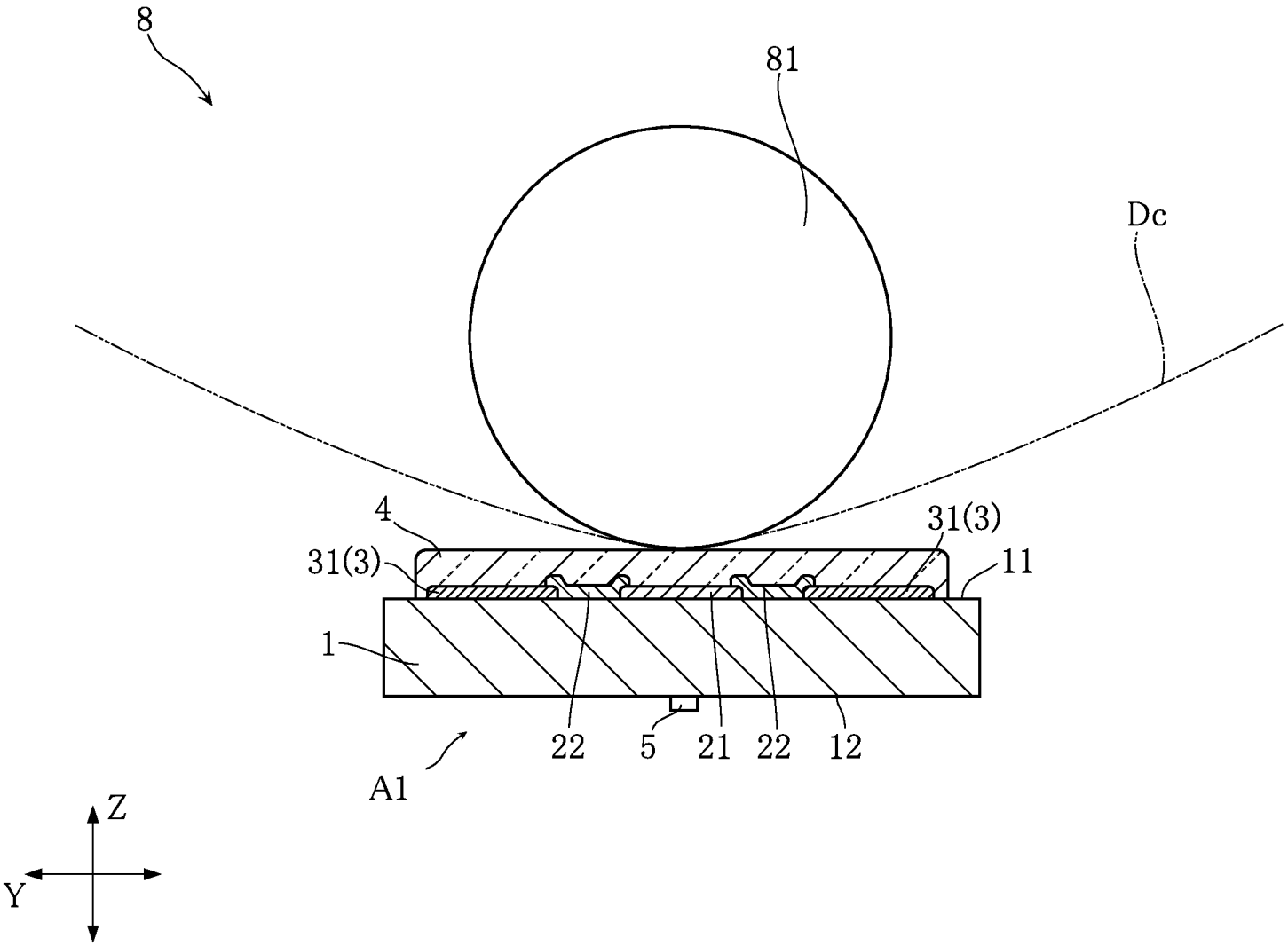
FIG. 1 is a fragmentary cross-sectional view of a printing apparatus that includes a heater according to a first embodiment of the present invention.

FIG. 1 illustrates a part of a printing apparatus 8 incorporating a heater according to the first embodiment of the present invention. The printing apparatus 8 may be, for example, an electronic copier, a facsimile machine or a monofunctional printer, without limitation thereto. The printing apparatus 8 includes a heater A1 and a platen roller 81.

The heater A1 is opposed to the platen roller 81, and serves to thermally fix toner, transferred to a printing medium Dc, onto the printing medium Dc. Although the printing medium Dc can be typically exemplified by a paper sheet, different types of recording medium may be employed.

As shown in FIG. 1 to FIG. 5, the heater A1 includes a substrate 1, a heating resistor layer 2, an electrode layer 3, a protection layer 4, and a thermistor 5.

Figure 2:
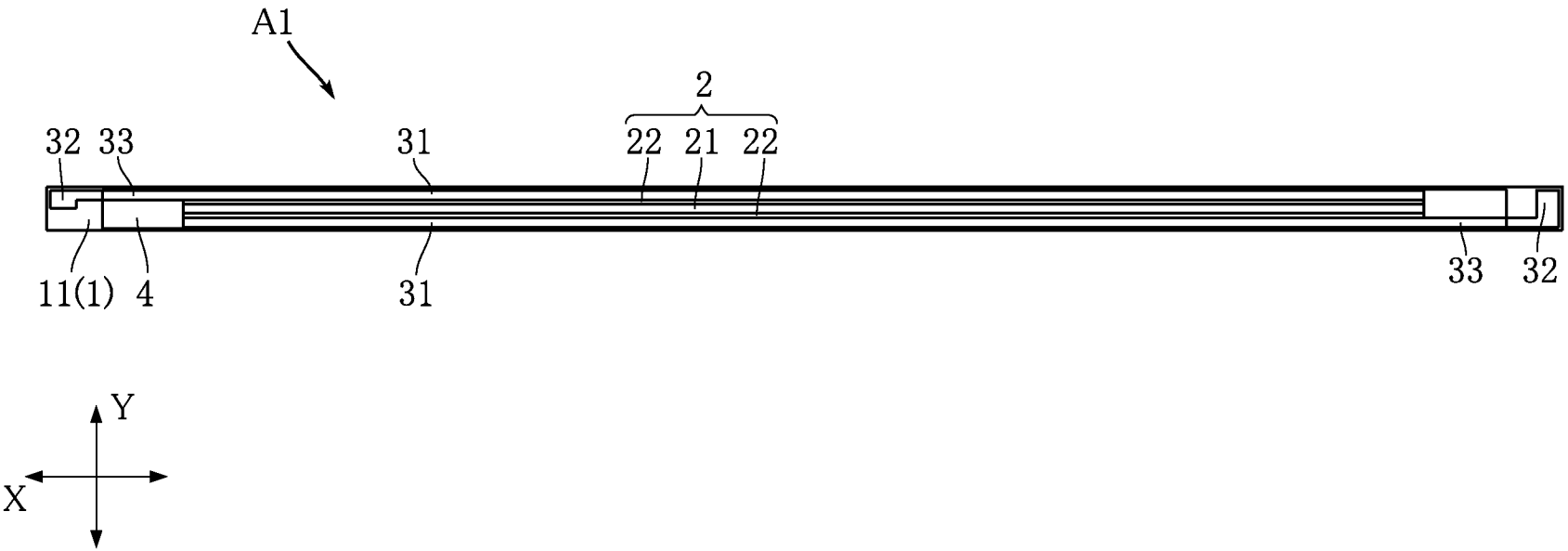
FIG. 2 is a plan view showing the heater according to the first embodiment of the present invention.
Figure 3:
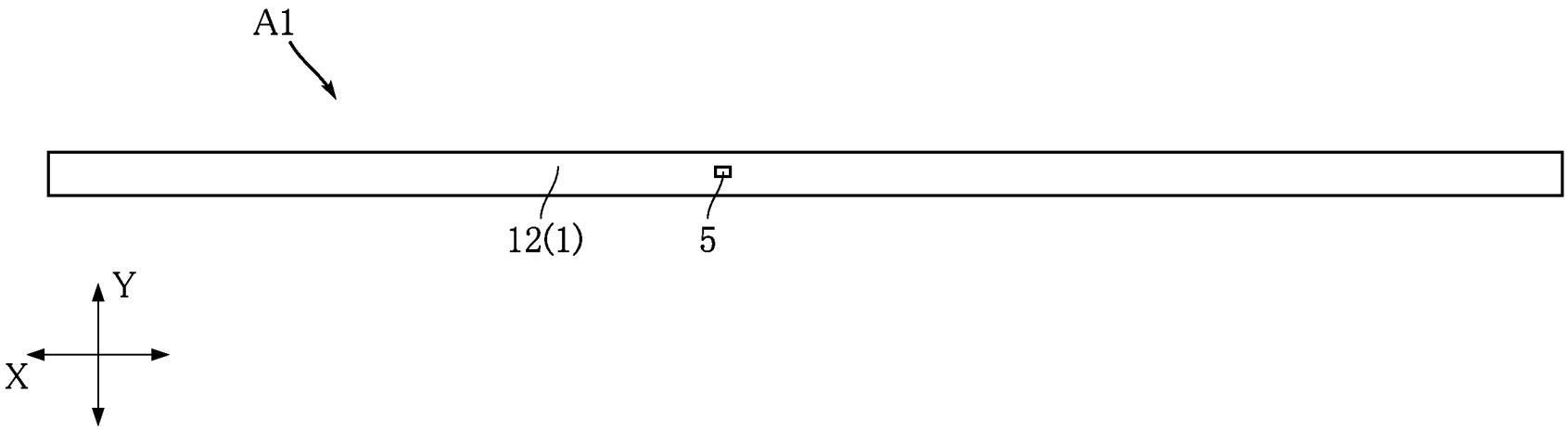
FIG. 3 is a bottom view of the heater shown in FIG. 2.
Figure 4:
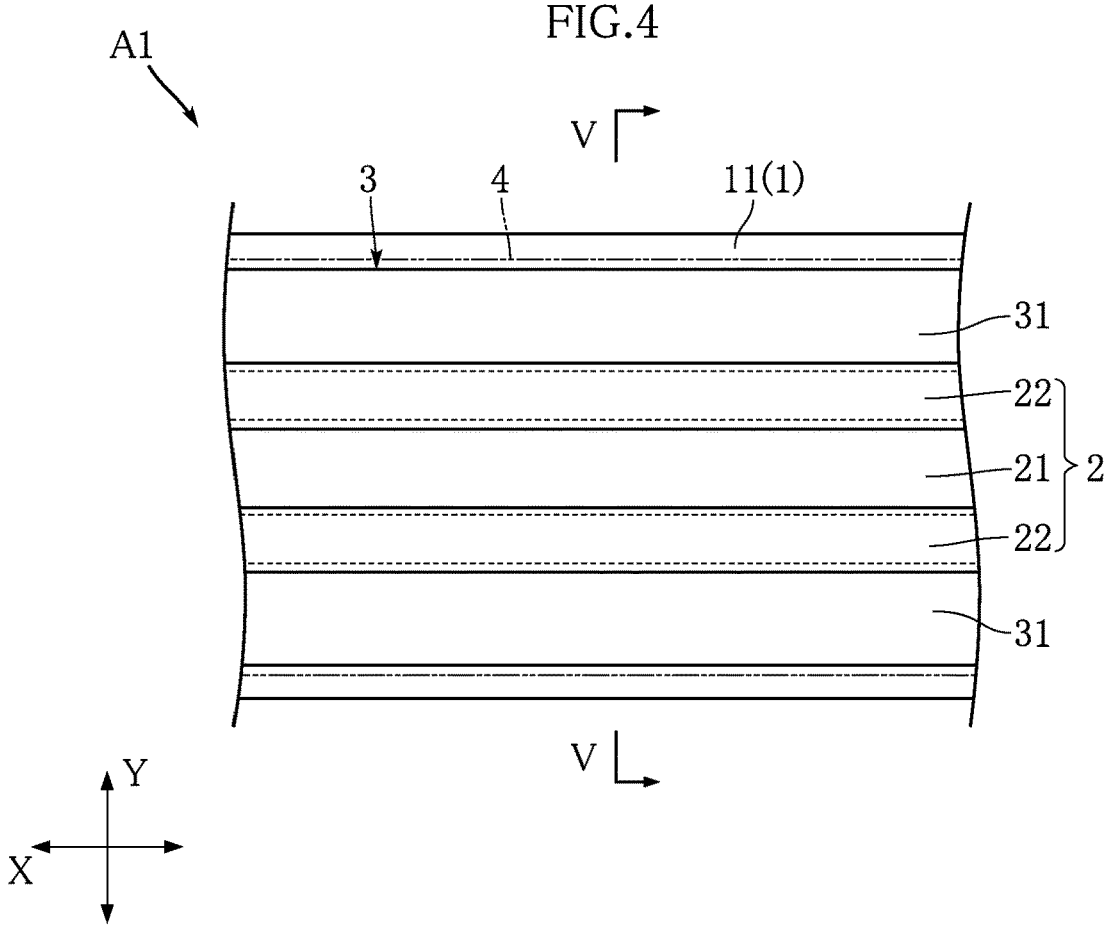
FIG. 4 is an enlarged fragmentary plan view of the heater shown in FIG. 2.

As shown in FIG. 2, the substrate 1 has an elongate shape extending in an X-direction. In the subsequent description and drawings referred to hereafter, the X-direction will be referred to as longitudinal direction X, and a Y-direction will be referred to as width direction (or shorter edge direction)

Y. In addition, a Z-direction (see FIG. 1 and FIG. 5) orthogonal to both of the X-direction and the Y-direction will be referred to as thickness direction Z. The width direction Y corresponds to the transport direction of the printing medium Dc, and the longitudinal direction X corresponds to the width direction of the printing medium Dc.

The substrate 1 is, for example, made of an insulative material. In this embodiment, the substrate 1 is made of a ceramic. Examples of the ceramic material include alumina and aluminum nitride.

The substrate 1 has a thickness of, for example, 0.4 to 1.2 mm. In another embodiment, the substrate 1 may have a thickness of 0.4 to 0.6 mm. When the substrate 1 is made of a material having low thermal conductivity, such as alumina or aluminum nitride, it is preferable that the substrate 1 is thinner.

The substrate 1 has an obverse surface 11 and a reverse surface 12. In this embodiment, the obverse surface 11 and the reverse surface 12 are both flat. The obverse surface 11 and the reverse surface 12 are spaced apart from each other in the thickness direction Z, and arranged to face in opposite directions. The obverse surface 11 and the reverse surface 12 both have an elongate rectangular shape (see FIG. 2 and FIG. 3).

The heating resistor layer 2 is formed on the obverse surface 11. The heating resistor layer 2 generates heat when power is supplied thereto. The heating resistor layer 2 has a size of, for example, 290 mm to 310 mm in the longitudinal direction. This size is adopted on the assumption that the maximum size of a printing medium Dc to be used by the printing apparatus 8 is A3, however the heating resistor layer 2 may be formed in a different size. The width of the heating resistor layer 2 is constant all the way along the longitudinal direction. The heating resistor layer 2 includes at least one main heating member and at least one sub heating member, located adjacent to each other. In this embodiment, as will be described below, the heating resistor layer 2 includes one main heating member 21 and a pair of sub heating members 22.

The main heating member 21 has a strip shape extending in the longitudinal direction X with a constant width. The main heating member 21 is, for example, made of a material containing ruthenium oxide. The main heating member 21 may contain copper oxide for example, to adjust the temperature coefficient of resistance.

The pair of sub heating members 22 each have a strip shape extending in the longitudinal direction X with a constant width. In this embodiment, the sub heating members 22 have the same width. The sub heating members 22 are spaced apart from each other in the width direction Y, with the main heating member 21 interposed therebetween. The sub heating members 22 are, for example, made of a material containing ruthenium oxide, and may also contain copper oxide for example, to adjust the temperature coefficient of resistance.

The thickness of the main heating member 21 may be, for example, 5 μm to 15 μm, and is approximately 10 μm in this embodiment. The thickness of the sub heating members 22 may be, for example, 5 μm to 15 μm, and is approximately 10 μm in this embodiment. The width of the main heating member 21 may be, for example, 1.0 mm to 2.0 mm, and is approximately 1.6 mm in this embodiment. The total width of the two sub heating members 22 may be 1.0 mm to 2.0 mm for example, and is approximately 1.6 mm in this embodiment. Accordingly, the width of the heating resistor layer 2 may be, for example, 2.0 mm to 4.0 mm, and is approximately 3.2 mm in this embodiment.

The sub heating members 22 are made of a material having a higher temperature coefficient of resistance than that of the main heating member 21. The temperature coefficient of resistance of the main heating member 21 may be 0 ppm/° C. to 500 ppm/° C. for example, and is approximately 250 ppm/° C. in this embodiment. The temperature coefficient of resistance of the sub heating member 22 may be 2000 ppm/° C. to 3000 ppm/° C. for example, and is approximately 2500 ppm/° C. in this embodiment. Preferably, the temperature coefficient of resistance of the sub heating member 22 may be three times to fifteen times as high as the temperature coefficient of resistance of the main heating member 21, and is approximately ten times as high in this embodiment.

The main heating member 21 has a predetermined resistance (transverse resistance) measured along a path crossing the main heating member (along the width direction Y). Likewise, the sub heating members 22 also have a predetermined resistance (transverse resistance) measured along a path crossing the main heating member (along the width direction Y). In this embodiment, the transverse resistance of the main heating member 21 is higher than the total transverse resistance of the two sub heating members 22, for example at a reference temperature. The width of the main heating member 21 is substantially equal to the total width of the two sub heating members 22. Therefore, the sheet resistance of the main heating member 21 at the reference temperature is higher than the sheet resistance of the sub heating members 22 at the reference temperature. The sheet resistance of the main heating member 21 at the reference temperature may be 1500 Ω/sq to 2500 Ω/sq for example, and is approximately 2072 Ω/sq in this embodiment. The sheet resistance of the sub heating members 22 at the reference temperature may be 500 Ω/sq to 800 Ω/sq for example, and is approximately 691 Ω/sq in this embodiment.

Figure 6:
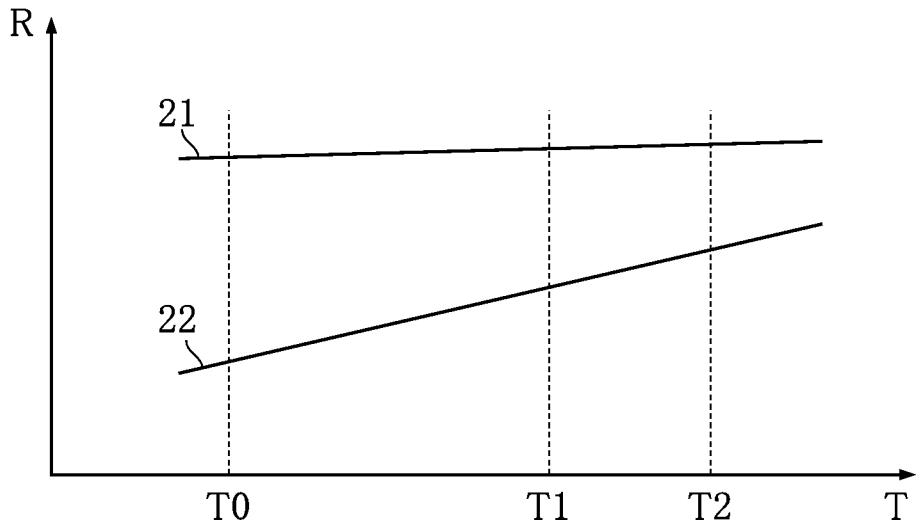
FIG. 6 is a graph showing the relationship between sheet resistance and temperature, of a heating resistor in the heater shown in FIG. 2.

FIG. 6 represents a relationship between the sheet resistance (R) and the temperature (T) of the main heating member 21 and the sub heating members 22. As is apparent from FIG. 6, the sheet resistance of the main heating member 21 is higher than that of the sub heating members 22 at a reference temperature T0 (e.g., 20° C.). At temperatures T1 and T2 also, assumed to be reached when the heater is in operation, the sheet resistance of the main heating member 21 is higher than that of the sub heating member 22. In contrast, the temperature coefficient of resistance of the sub heating members 22 is relatively higher than that of the main heating member 21. Accordingly, the sheet resistance of the sub heating members increases at a higher rate with the increase of the temperature than the sheet resistance of the main heating member 21.

As shown in FIG. 2, the electrode layer 3 includes a pair of strip-shaped portions 31, a pair of pads 32 and a pair of connectors 33. The electrode layer 3 constitutes a conduction path through which a current for causing the heating resistor layer 2 to generate heat is supplied. The electrode layer 3 is, for example, made of a material containing Ag. The thickness of the electrode layer 3 may be 5 μm to 15 μm for example, and is approximately 10 μm in this embodiment.

The pair of strip-shaped portions 31 each have an elongate shape extending in the longitudinal direction X. The strip-shaped portions 31 are spaced in parallel from each other in the width direction Y. The heating resistor layer 2 is located between the strip-shaped portions 31 (see FIG. 4 and FIG. 5).

The width of each of the strip-shaped portions 31 may be, for example, 1.5 mm to 2.5 mm, and is approximately 2.0 mm in this embodiment, which is wider than the widths of the main heating member 21 and each of the sub heating members 22. However, the heating resistor layer 2 as a whole is wider than each of the strip-shaped portions 31.

The pair of pads 32 serve for electrical conduction with the printing apparatus 8. The pads 32 are spaced apart from the heating resistor layer 2 and the pair of strip-shaped portions 31 in the longitudinal direction X. In this embodiment, the pads 32 are spaced apart from each other in the longitudinal direction X, with the heating resistor layer 2 and the strip-shaped portions 31 interposed therebetween.

The pair of connectors 33 each connect between one of the strip-shaped portions 31 and one of the pads 32 corresponding thereto. In this embodiment, the connectors 33 each have a strip shape extending in the longitudinal direction X.

Figure 5:
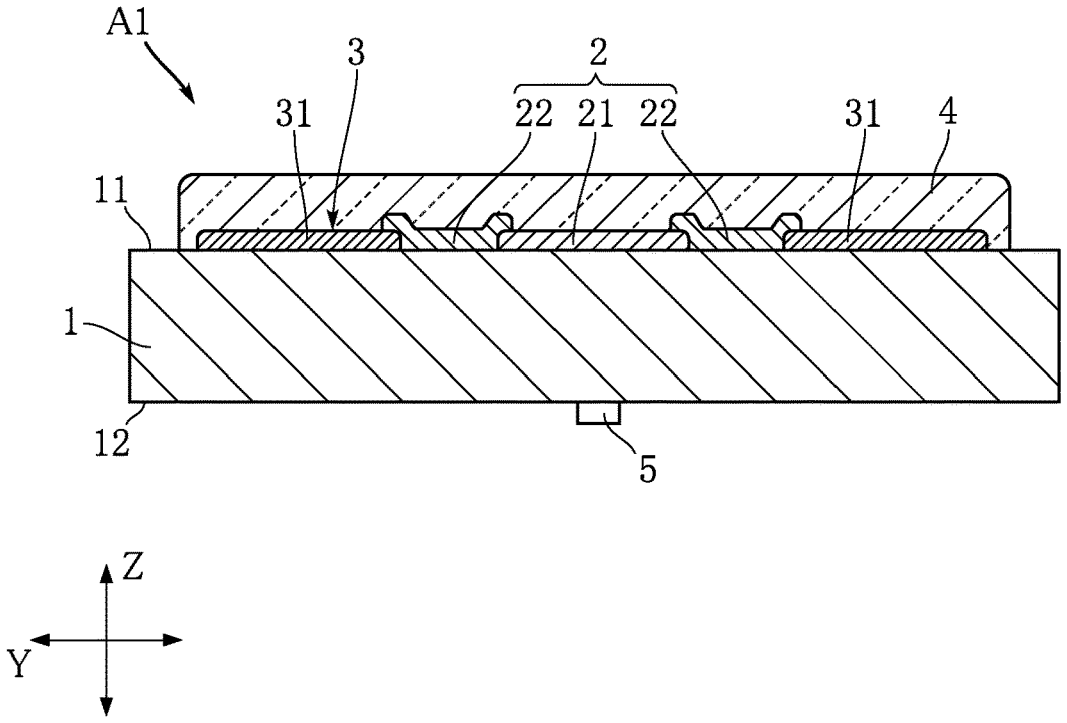
FIG. 5 is a cross-sectional view taken along a line V-V in FIG. 4.

As shown in FIG. 5, the sub heating members 22 each include an outer end portion and an inner end portion spaced apart from each other in the width direction Y, the outer end portion being located on one of the strip-shaped portions 31 corresponding thereto, and the inner end portion being located on the main heating member 21.

In this embodiment, the heating resistor layer 2 and the electrode layer 3 are formed directly on the obverse surface 11. Alternatively, an insulation layer, for example made of glass, may be provided on the obverse surface 11, so as to be interposed between the obverse surface 11 and each of the heating resistor layer 2 and the electrode layer 3.

The protection layer 4 covers the entirety of the heating resistor layer 2. The protection layer 4 also covers the electrode layer 3 except for the pair of pads 32 and the periphery thereof (see FIG. 2). In other words, the protection layer 4 covers a part of the electrode layer 3. The protection layer 4 is made of glass for example, in a thickness of 40 μm to 100 μm. In this embodiment, the protection layer 4 has a thickness of approximately 60 μm. As is apparent from FIG. 5, the width of the protection layer 4 is narrower than that of the substrate 1. In this embodiment, the protection layer 4 includes a pair of edges (right edge and left edge in FIG. 5) spaced apart from each other in the width direction Y. Likewise, the substrate 1 includes a pair of edges (right edge and left edge in FIG. 5) spaced apart from each other in the width direction Y. In the width direction Y, the right edge of the protection layer 4 is inwardly shifted (toward the main heating member 21) from the right edge of the substrate 1. Likewise, the left edge of the protection layer 4 is inwardly shifted (toward the main heating member 21) from the left edge of the substrate 1.

The thermistor 5 serves as a sensor for detecting the temperature of the heater A1 when the heater A1 is activated. In this embodiment, the thermistor 5 is located on the reverse surface 12 of the substrate 1. The power to be supplied to the heater A1 is controlled according to the detection result of the thermistor 5.

Figure 7:
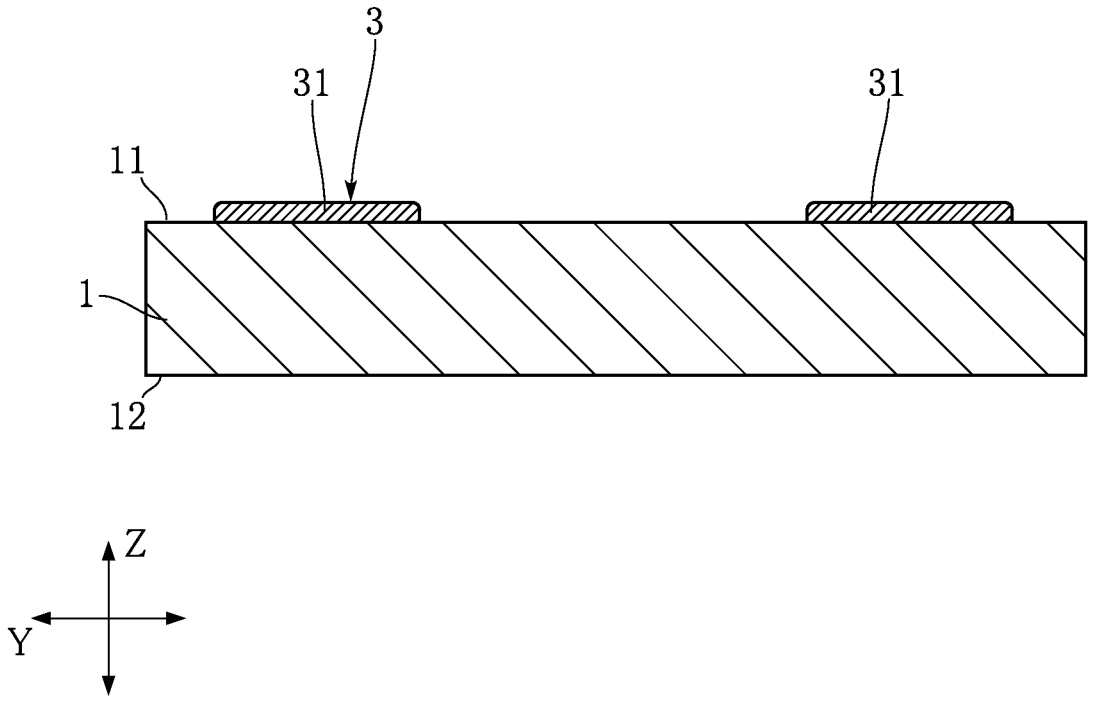
FIG. 7 is a cross-sectional view showing a process in a manufacturing method of the heater shown in FIG. 2.
Figure 8:
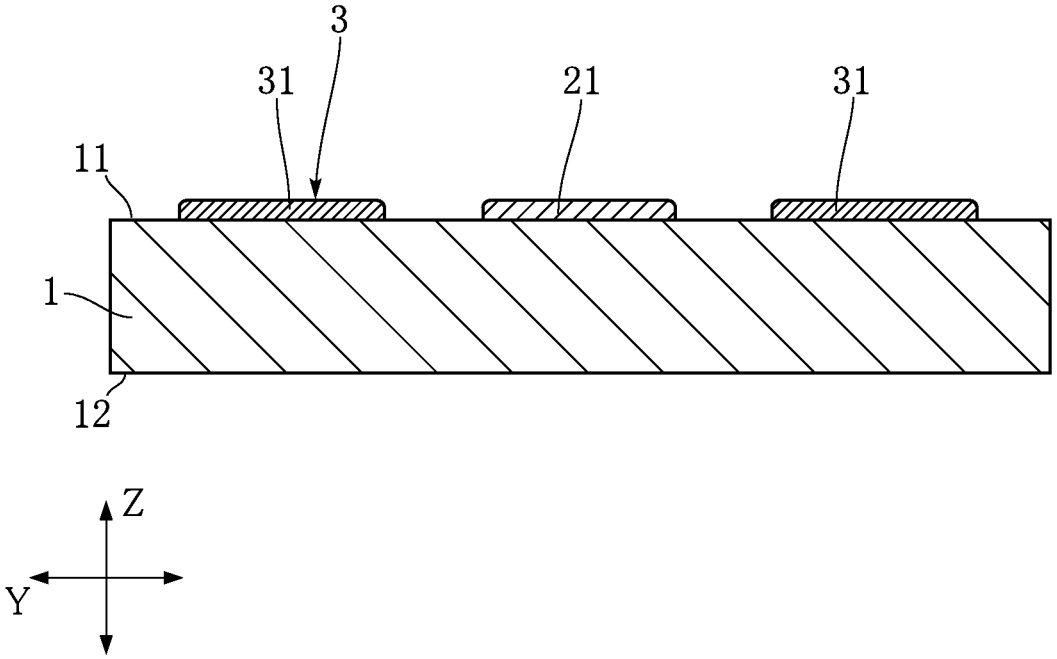
FIG. 8 is a cross-sectional view showing a process in the manufacturing method of the heater shown in FIG. 2.
Figure 9:
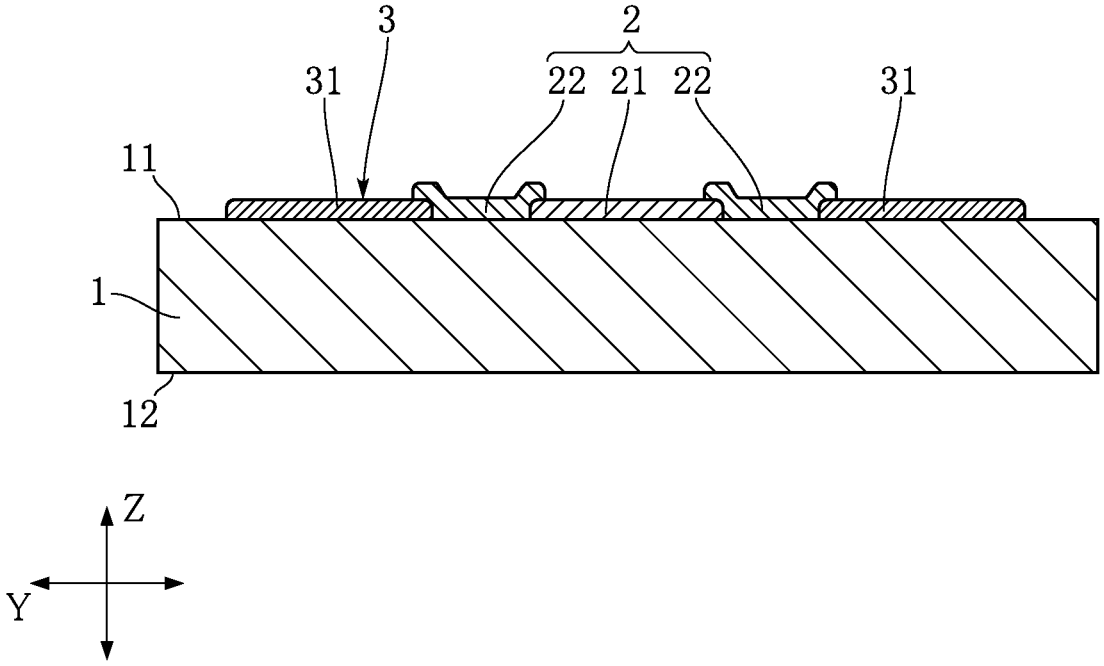
FIG. 9 is a cross-sectional view showing a process in the manufacturing method of the heater shown in FIG. 2.

Referring now to FIG. 7 to FIG. 9, a manufacturing method of the heater A1 will be described.

Referring first to FIG. 7, the substrate 1 is prepared, and a conductive paste is printed on the obverse surface 11. The conductive paste contains Ag, for example. Upon sintering the printed conductive paste, the electrode layer 3 including the pair of strip-shaped portions 31 is obtained.

Proceeding to FIG. 8, the main heating member 21 is formed on the obverse surface 11, for example through the following process. The obverse surface 11 includes a region located between the pair of strip-shaped portions 31 in the width direction Y. A conductive paste, for example containing ruthenium oxide, is printed on the mentioned region. In this process, the conductive paste is printed with a spacing from the strip-shaped portions 31. Upon sintering the conductive paste thus printed, the main heating member 21 is obtained.

Proceeding to FIG. 9, two sub heating members 22 are formed on the obverse surface 11, for example through the following process. The obverse surface 11 includes two regions each located between the main heating member 21 and one of the strip-shaped portions 31. A conductive paste, for example containing ruthenium oxide and copper oxide, is printed on the mentioned regions. In this process, the conductive paste is printed such that the conductive paste is made to contact both of the main heating member 21 and one of the strip-shaped portions 31, in each of the regions. In this embodiment, the conductive paste applied as above covers the inner end portions of the respective strip-shaped portions 31 and the both end portions of the main heating member 21. Upon sintering the conductive paste applied as above, the pair of sub heating members 22 can be obtained. The sintering process for forming the heating resistor layer 2 and the electrode layer 3 may be performed either separately or at a time. After the formation of the sub heating member 22, the protection layer 4 is formed and the thermistor 5 is mounted, so that the heater A1 is obtained.

The heater A1 configured as above provides the following advantageous effects.

Figure 10:
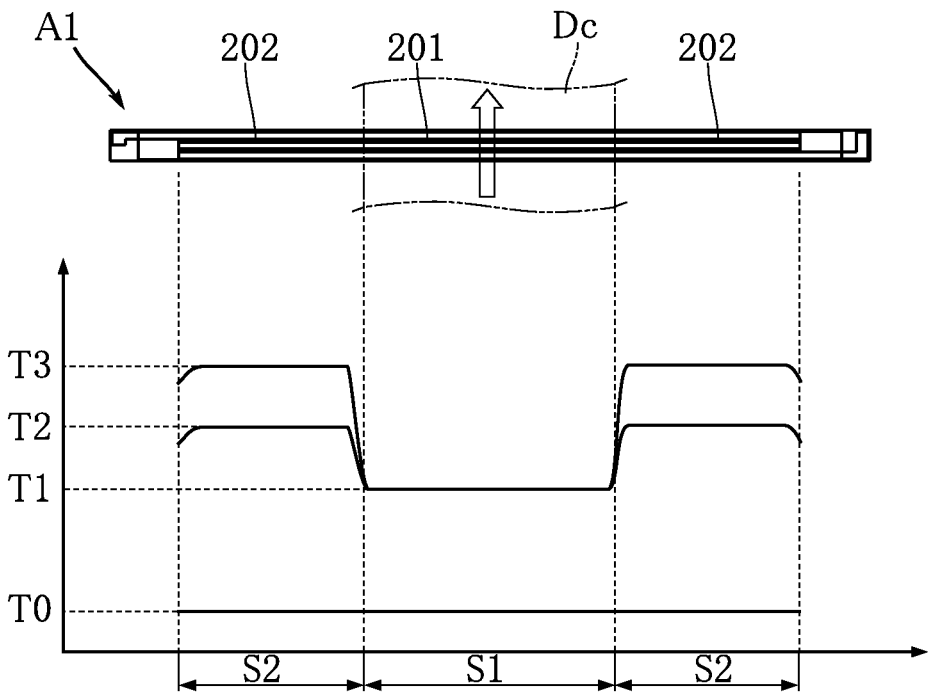
FIG. 10 includes a plan view showing an example of use of the heater shown in FIG. 2 and a temperature graph thereof.

FIG. 10 illustrates an example of use of the heater A1. FIG. 10 includes a plan view of the heater A1 in an upper portion, and the printing medium Dc is indicated by imaginary lines. The printing medium Dc is transported by the platen roller 81 (see FIG. 1) in the direction indicated by an arrow, in sliding contact with the heater A1. The example represents the case where the size of the printing medium Dc is relatively small with respect to the heater A1. For example, whereas the heater A1 is designed for a printing medium of A3 size, the printing medium Dc used herein is of A4 size. Referring to FIG. 10, a section of the heater A1 in the longitudinal direction where the printing medium Dc passes will be referred to as sheet passing section S1, and sections deviated from the printing medium Dc will be referred to as non-passing section S2.

When the power is not supplied, the heating resistor layer 2 does not generate heat, and hence the temperature of the heating resistor layer 2 is the reference temperature T0, for example. When the printing medium Dc starts to be transported and the power starts to be supplied to the heating resistor layer 2, the heating resistor layer 2 generates heat. In the sheet passing section S1, the heat of the heating resistor layer 2 is transmitted to the printing medium Dc. In the non-passing section S2, in contrast, the heat of the heating resistor layer 2 is not transmitted to the printing medium Dc. Accordingly, the temperature of the heater A1 becomes relatively higher in the non-passing section S2, compared with the temperature in the sheet passing section S1.

Here, it will be assumed that the temperature of the sheet passing section S1 has reached a temperature T1 under a certain condition. It will also be assumed that, unlike in this embodiment, the heating resistor layer 2 is only composed of the main heating member 21. In such a case, the temperature in the non-passing section S2 excessively increases so as to reach a temperature T3. In this embodiment, on the other hand, the heating resistor layer 2 includes the main heating member 21 and the pair of sub heating members 22. Since the sub heating members 22 have a higher temperature coefficient of resistance, the sheet resistance becomes higher with the increase of the temperature. Accordingly, with the increase of the temperature of the non-passing section S2, the sheet resistance of the sub heating members 22 located in the non-passing section S2 (hereinafter, non-passing region 202) becomes higher than the sheet resistance of the sub heating members 22 located in the sheet passing section S1 (hereinafter, sheet passing region 201). Therefore, the current flowing from the electrode layer toward the heating resistor layer 2 circumvents the non-passing region 202 so as to concentrate in the sheet passing region 201. As a result, the calorific value in the portion of the heating resistor layer 2 (in particular, main heating member 21) corresponding to the non-passing section S2 is suppressed, and therefore the temperature in the non-passing section S2 becomes T2, which is lower than T3. Thus, with the configuration according to this embodiment, the temperature in the non-passing section S2 can be prevented from excessively rising, compared with the temperature in the sheet passing section S1.

Generally, it may be difficult to increase both of the temperature coefficient of resistance and the sheet resistance, in a single heating device. For example, a material having a high temperature coefficient of resistance tends to have low sheet resistance. In this embodiment, the sub heating members 22 having a relatively high temperature coefficient of resistance are employed in collaboration with the main heating member 21 having relatively high sheet resistance. Combining thus the two types of heating members having different resistance characteristics provides the following technical advantages. When the heater A1 is in operation, the sheet resistance of the portion of the sub heating members 22 corresponding to the non-passing section S2 becomes relatively higher. Therefore, as stated above, the current tends to circumvent the non-passing region 202 so as to flow through the sheet passing region 201. In other words, the non-passing region 202 serves as a barrier to block the flow of the current being supplied. Yet, the necessary calorific value for fixing the toner can be secured by the main heating member 21, the resistance of which barely depends on the temperature (having larger sheet resistance).

In addition, in the heating resistor layer 2 according to this embodiment the main heating member 21 is interposed between the pair of sub heating members 22 in the width direction Y. Accordingly, in the non-passing section S2, the main heating member 21 is electrically closed by the two non-passing regions 202. Such a configuration contributes to suppressing the temperature rise in the non-passing section S2. Preferably, further, the thermal conductivity of the sub heating members 22 may be set to a lower level than the thermal conductivity of the strip-shaped portions 31 of the electrode layer 3. In this case, in the sheet passing section S1 in particular, the heat generated in the main heating member 21 can be prevented from escaping to the strip-shaped portion 31 through the sub heating members 22.

Preferably, the temperature coefficient of resistance of the sub heating member 22 may be three times to fifteen times the temperature coefficient of resistance of the main heating member 21. Such a setting enhances the suppressing effect against the temperature rise in the non-passing section S2.

FIG. 11 to FIG. 15 illustrate a variation of the first embodiment, and some other embodiments. In these drawings, the elements same as or similar to those of the first embodiment are denoted by the same numeral.

Figure 11:
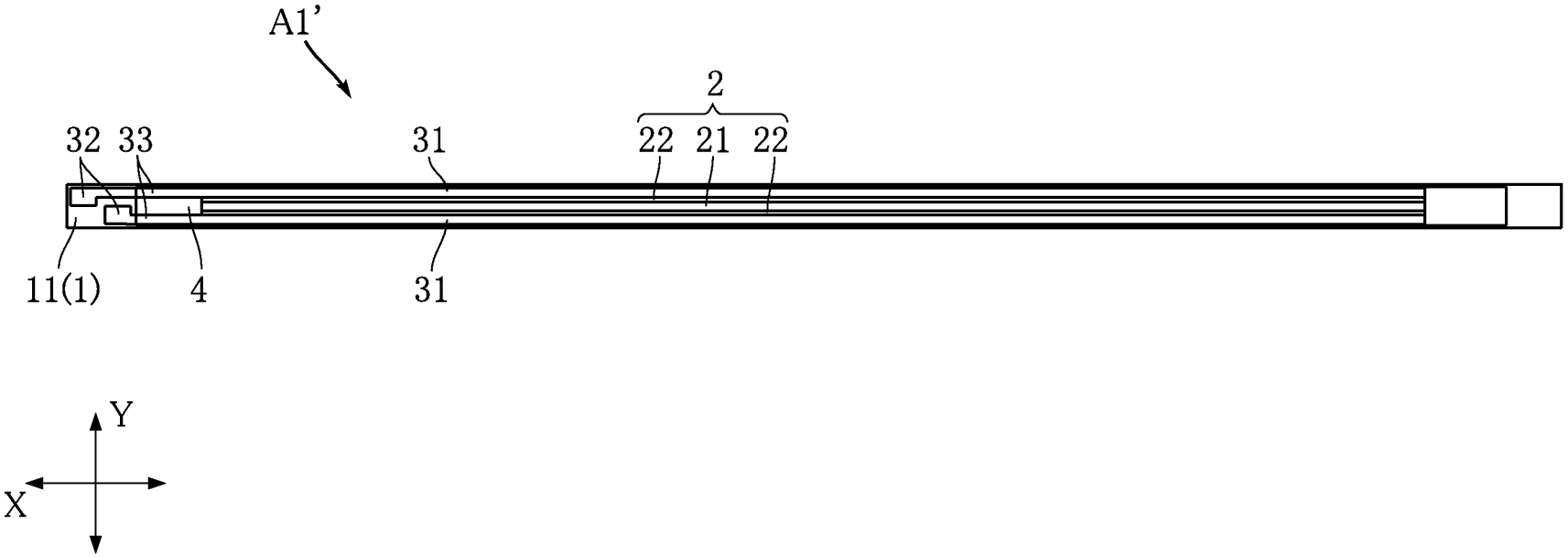
FIG. 11 is a plan view showing a variation of the heater shown in FIG. 2.

FIG. 11 illustrates the variation of the heater A1 described above. In the heater A1' illustrated therein, the pair of pads 32 are located on the same side of the pair of strip-shaped portions 31, in the longitudinal direction X. Such a configuration also suppresses the temperature rise in the non-passing section S2. As is understood from this variation, the position of the pair of pads 32 may be arranged as desired. For example, the pads 32 may be provided on the reverse surface 12. Such a variation of the pair of pads 32 is equally applicable to other embodiments to be described below.

Figure 12:
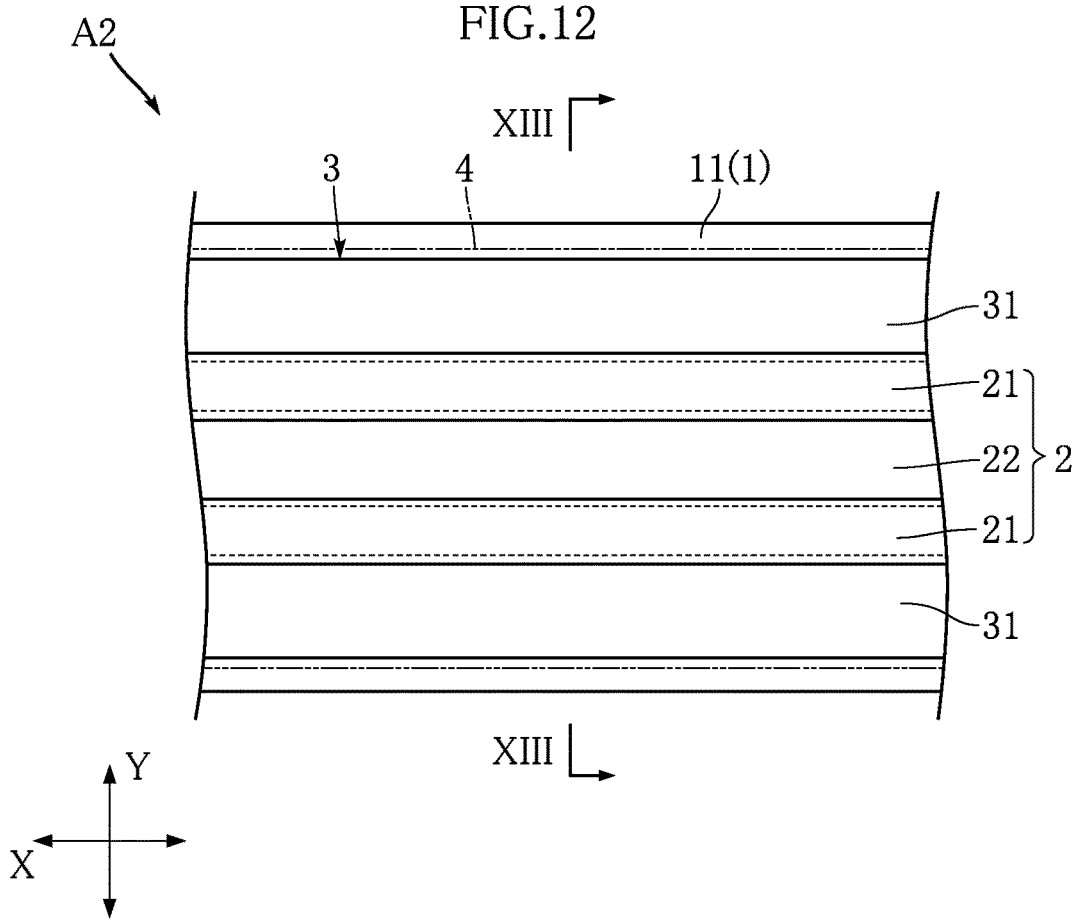
FIG. 12 is a fragmentary cross-sectional view of a heater according to a second embodiment of the present invention.
Figure 13:
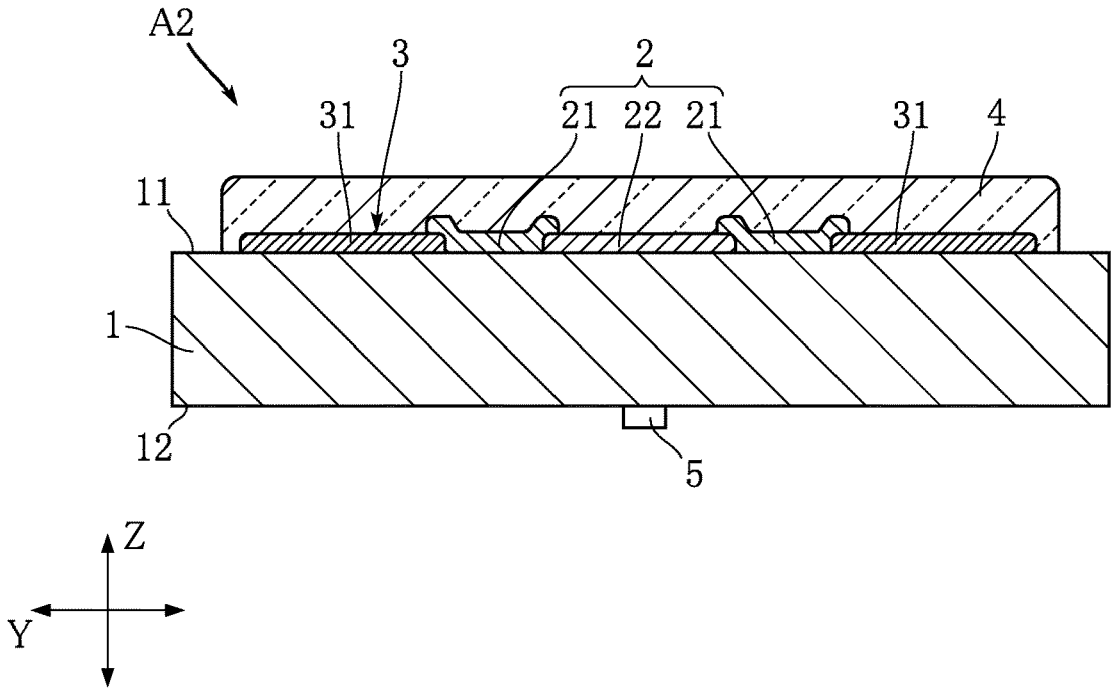
FIG. 13 is a cross-sectional view taken along a line XIII-XIII in FIG. 12.

FIG. 12 and FIG. 13 illustrate a heater according to a second embodiment of the present invention. The heater A2 according to this embodiment is different from the heater A1 according to the first embodiment in the configuration of the heating resistor layer 2. More specifically, the heating resistor layer 2 of the heater A2 includes a pair of main heating members 21 and one sub heating member 22. In this embodiment, the width of the sub heating member 22 is approximately twice the width of each of the main heating members 21, and narrower than the width of each of the strip-shaped portions 31. However, the heating resistor layer 2 as a whole is wider than each of the strip-shaped portions 31. As a matter of course, the present invention is not limited to such configurations.

In this embodiment, the sub heating member 22 is interposed between the pair of main heating members 21, in the width direction Y. The main heating members 21 each include an outer end portion in the width direction Y, located on the corresponding one of the strip-shaped portions 31. The respective inner end portions of the main heating members 21 in the width direction Y are located on the sub heating member 22.

In the heater A2 also, the sheet resistance of the non-passing region 202 corresponding to the non-passing section S2 is higher than that of the sheet passing region 201 corresponding to the sheet passing section S1 (see FIG. 10). Accordingly, the current from the electrode layer 3 tends to concentrate in the sheet passing section S1, and therefore the excessive temperature rise in the non-passing section S2 can be suppressed.

Figure 14:
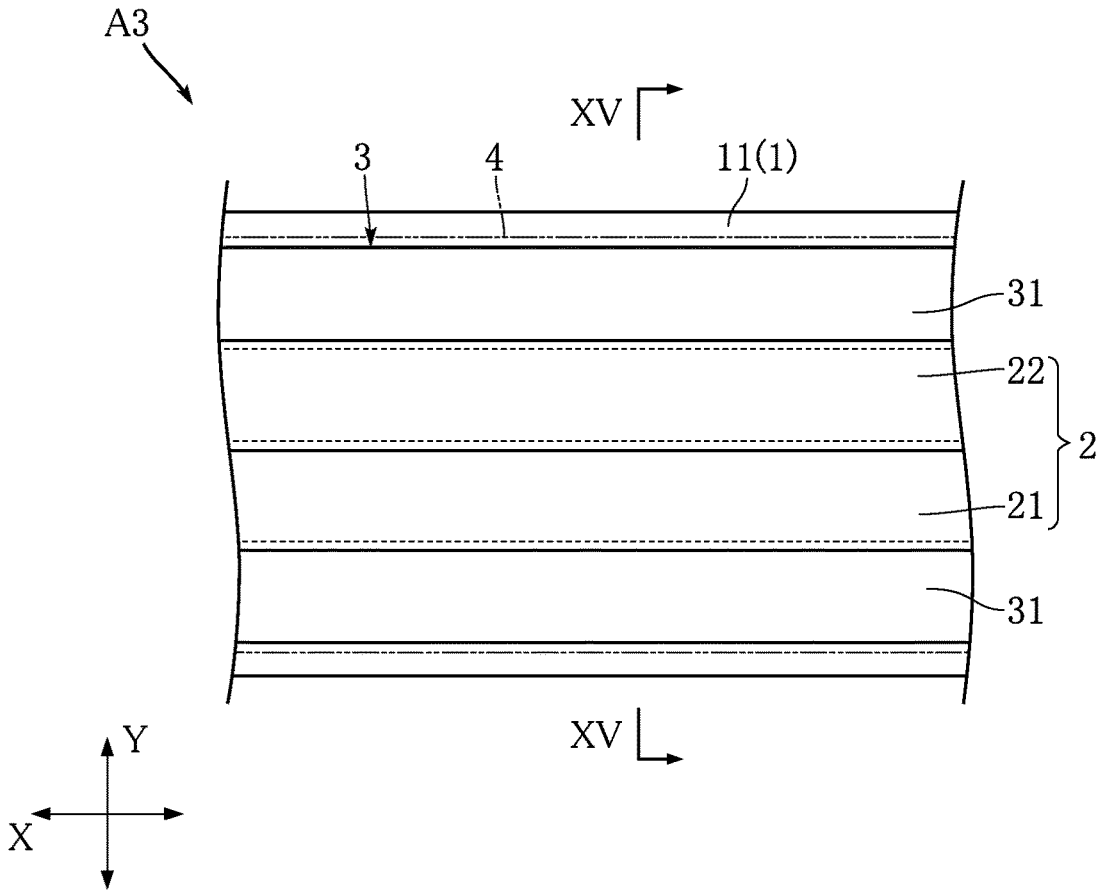
FIG. 14 is a fragmentary cross-sectional view of a heater according to a third embodiment of the present invention.
Figure 15:
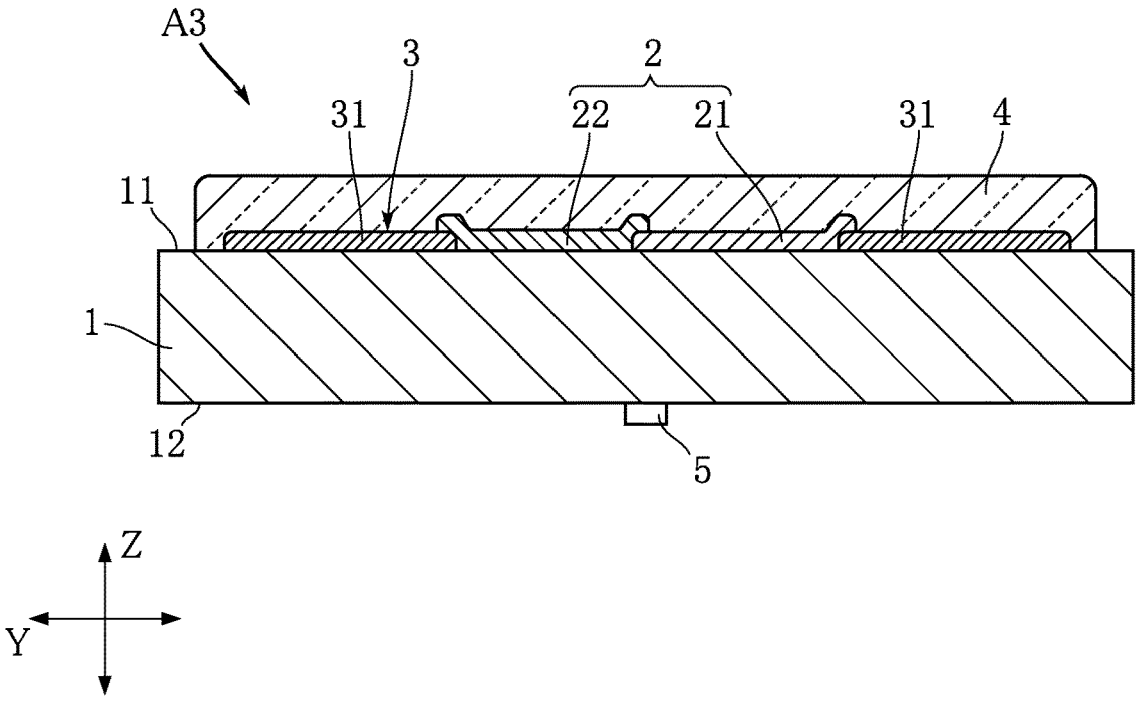
FIG. 15 is a cross-sectional view taken along a line XV-XV in FIG. 14.

FIG. 14 and FIG. 15 illustrate a heater according to a third embodiment of the present invention. The heater A3 illustrated in these drawings is different from the heater A1 and heater A2 described above, in the configuration of the heating resistor layer 2. More specifically, the heating resistor layer 2 of the heater A3 includes one main heating member 21 and one sub heating member 22. In this embodiment, the width of the main heating member 21 is substantially the same as the width of the sub heating member 22. In addition, the width of the main heating member 21 (i.e., width of the sub heating member 22) is narrower than the width of each of the strip-shaped portions 31. However, the heating resistor layer 2 as a whole is wider than each of the strip-shaped portions 31. As a matter of course, the present invention is not limited to such configurations.

In the heater A3, the single sub heating member 22 and the single main heating member 21 are located adjacent to each other in the width direction Y, between the pair of strip-shaped portions 31. In other words, the main heating member 21 and the sub heating member 22 are partially in contact with each other. In addition, the outer end portion (right end portion) of the main heating member 21 is located on one of the strip-shaped portions 31 (strip-shaped portion on the right), in the width direction Y (see FIG. 15). Likewise, the outer end portion (left end portion) of the sub heating member 22 is located on the other strip-shaped portion 31 (strip-shaped portion on the left), in the width direction Y. In the configuration illustrated in FIG. 15, the inner end portion (right end portion) of the sub heating member 22 is located on the main heating member 21. However, the inner end portion (left end portion) of the main heating member 21 may be located on the sub heating member 22.

In the heater A3 also, the sheet resistance of the non-passing region 202 corresponding to the non-passing section S2 is higher than that of the sheet passing region 201 corresponding to the sheet passing section S1. Accordingly, the current from the electrode layer 3 tends to concentrate in the sheet passing section S1, and therefore the excessive temperature rise in the non-passing section S2 can be suppressed.

Referring now to FIG. 16 to FIG. 30, an embodiment representing a second aspect of the present invention will be described hereunder.

Figure 16:
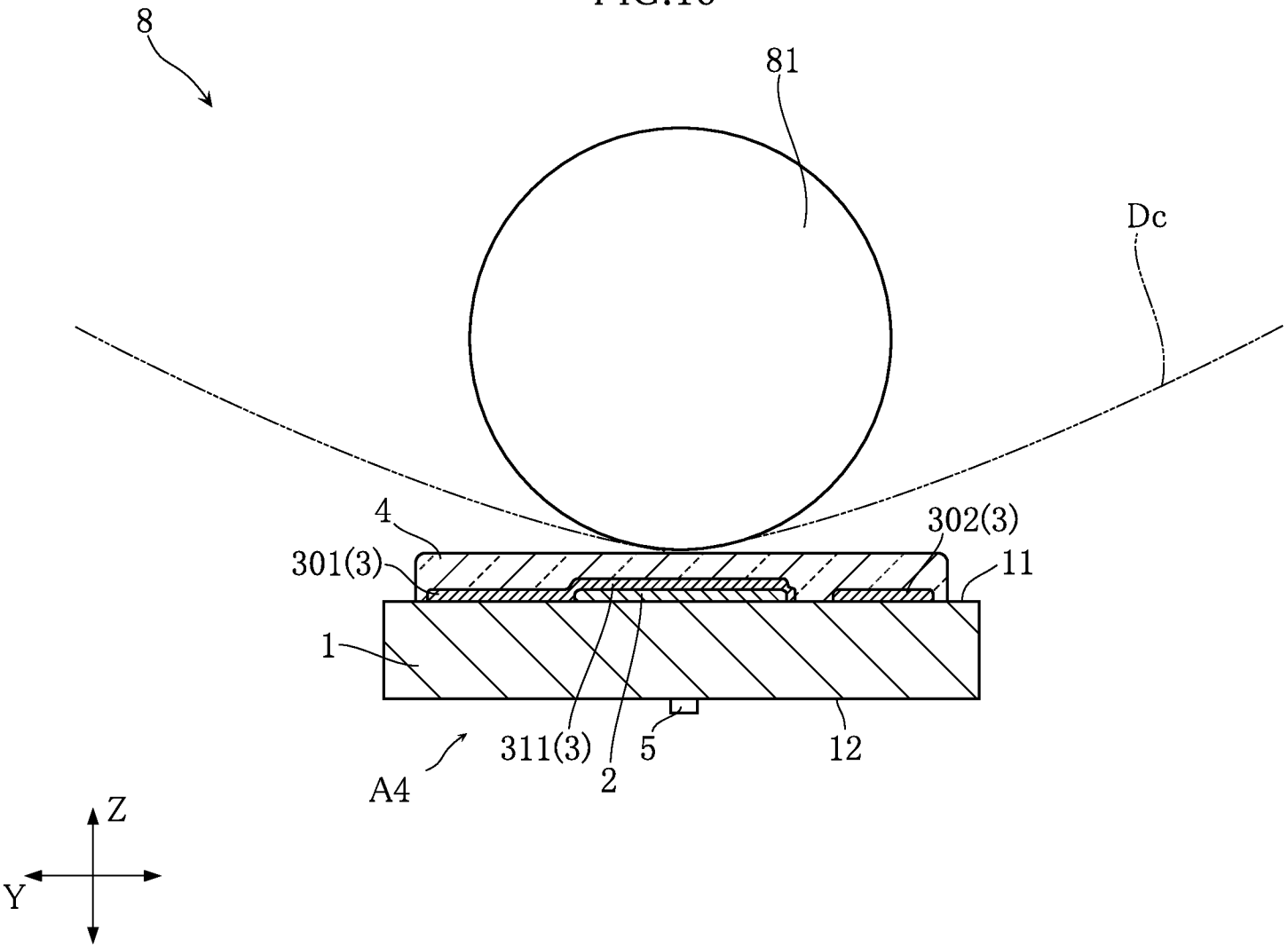
FIG. 16 is a fragmentary cross-sectional view of a printing apparatus that includes a heater according to a fourth embodiment of the present invention.
Figure 17:
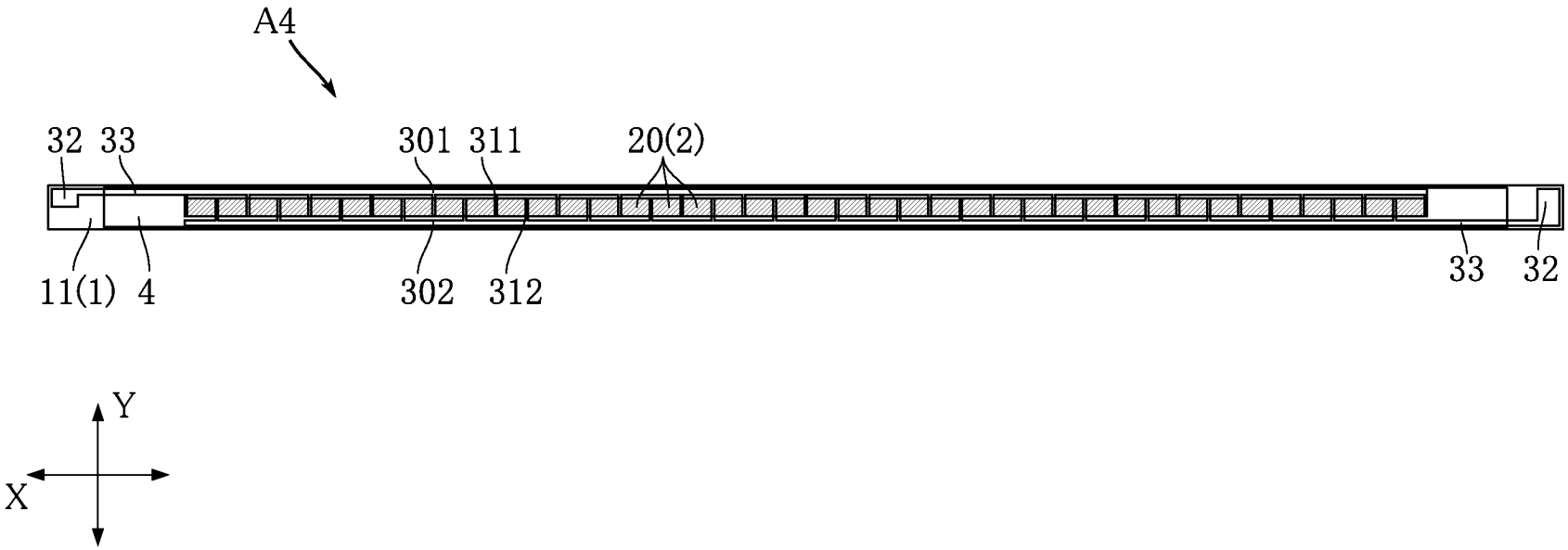
FIG. 17 is a plan view showing the heater according to the fourth embodiment of the present invention.
Figure 18:
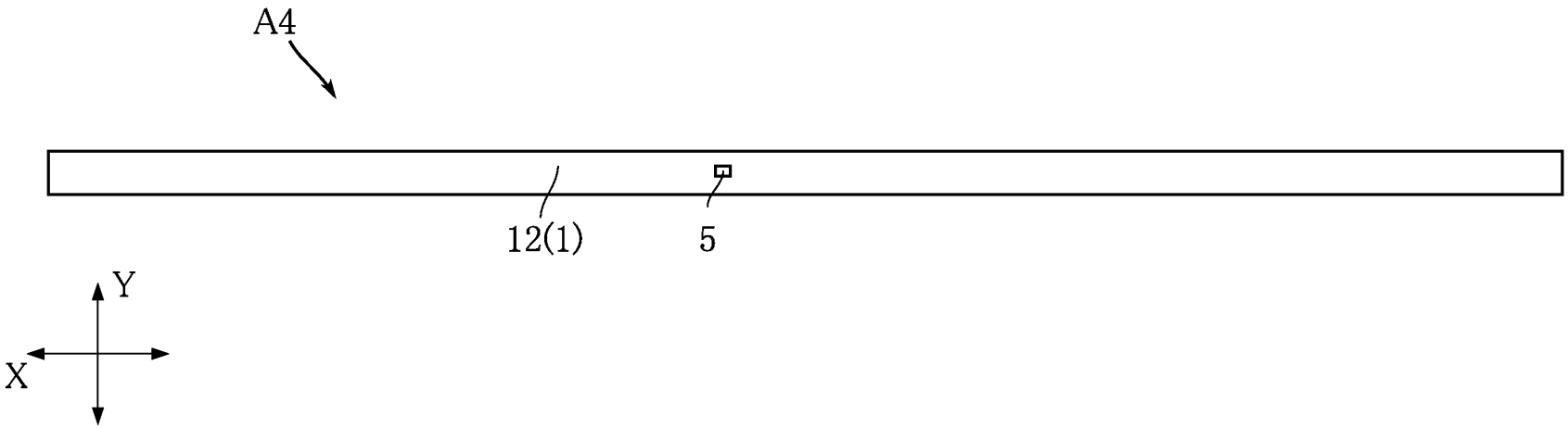
FIG. 18 is a bottom view of the heater shown in FIG. 17.

FIG. 16 illustrates a part of the printing apparatus 8 incorporating a heater according to a fourth embodiment of the present invention. The printing apparatus 8 may be, for example, an electronic copier, a facsimile machine or a monofunctional printer, without limitation thereto. The printing apparatus 8 includes a heater A4 and a platen roller 81.

The heater A4 is opposed to the platen roller 81, and serves to thermally fix toner, transferred to the printing medium Dc, onto the printing medium Dc. Although the printing medium Dc can be typically exemplified by a paper sheet, different types of recording medium may be employed.

As shown in FIG. 16 to FIG. 21, the heater A4 includes a substrate 1, a heating resistor layer 2, an electrode layer 3, a protection layer 4, and a thermistor 5.

The substrate 1 has an elongate shape extending in the X-direction. In the subsequent description and drawings referred to hereafter, as in the first to the third embodiments, the X-direction will be referred to as longitudinal direction X, the Y-direction will be referred to as width direction Y, and the Z-direction will be referred to as thickness direction Z. The width direction Y corresponds to the transport direction of the printing medium Dc, and the longitudinal direction X corresponds to the width direction of the printing medium Dc.

The substrate 1 is made of an insulative material. In this embodiment, the substrate 1 is made of a ceramic. Examples of the ceramic material include alumina and aluminum nitride.

The substrate 1 has a thickness of, for example, 0.4 to 1.2 mm. In another embodiment, the substrate 1 may have a thickness of 0.4 to 0.6 mm. When the substrate 1 is made of a material having low thermal conductivity, such as alumina or aluminum nitride, it is preferable that the substrate 1 is thinner.

The substrate 1 has the obverse surface 11 and the reverse surface 12. In this embodiment, the obverse surface 11 and the reverse surface 12 are both flat. The obverse surface 11 and the reverse surface 12 are spaced apart from each other in the thickness direction Z, and are arranged to face in opposite directions. The obverse surface 11 and the reverse surface 12 both have an elongate rectangular shape.

The heating resistor layer 2 is formed on the obverse surface 11. The heating resistor layer 2 generates heat when power is supplied thereto. The heating resistor layer 2 has a size of, for example, 290 mm to 310 mm in the longitudinal direction. This size is adopted on the assumption that a maximum size of the printing medium Dc to be used by the printing apparatus 8 is A3, however the heating resistor layer 2 may be formed in a different size. The heating resistor layer 2 according to this embodiment is formed in an elongate strip shape extending in the longitudinal direction X.

The heating resistor layer 2 is, for example, made of a material containing ruthenium oxide. The heating resistor layer 2 may also contain copper oxide for example, to adjust the temperature coefficient of resistance.

The width of the heating resistor layer 2 may be 1 mm to 5 mm for example, and is approximately 3 mm in this embodiment. The thickness of the heating resistor layer 2 may be 5 μm to 15 μm for example, and is approximately 10 μm in this embodiment.

The temperature coefficient of resistance of the heating resistor layer 2 may be 1500 ppm/° C. to 5000 ppm/° C. for example, and is approximately 2000 ppm/° C. in this embodiment. The sheet resistance of the heating resistor layer 2 at the reference temperature may be 10 Ω/sq to 2000 Ω/sq for example, and is approximately 500 Ω/sq in this embodiment.

The electrode layer 3 includes a first strip-shaped portion 301, a second strip-shaped portion 302, a plurality of first branch portions 311, a plurality of second branch portions 312, the pair of pads 32 and the pair of connectors 33. The electrode layer 3 constitutes a conduction path through which the current for causing the heating resistor layer 2 to generate heat is supplied. The electrode layer 3 is, for example, made of a material containing Ag. The thickness of the electrode layer 3 may be 5 μm to 15 μm for example, and is approximately 10 μm in this embodiment.

The first strip-shaped portion 301 and the second strip-shaped portion 302 each have an elongate shape extending in the longitudinal direction X. The first strip-shaped portion 301 and the second strip-shaped portion 302 are spaced in parallel from each other in the width direction Y. The heating resistor layer 2 is located between the first strip-shaped portion 301 and the second strip-shaped portion 302. The distance between the first strip-shaped portion 301 and the heating resistor layer 2 in the width direction Y is approximately 0.5 mm, which is narrower than the width of the heating resistor layer 2. The distance between the second strip-shaped portion 302 and the heating resistor layer 2 in the width direction Y is also approximately 0.5 mm, which is narrower than the width of the heating resistor layer 2.

The width of the first strip-shaped portion 301 may be, for example, 1.5 mm to 2.5 mm, and is approximately 2.0 mm in this embodiment. The width of the second strip-shaped portion 302 may be, for example, 1.5 mm to 2.5 mm, and is also approximately 2.0 mm in this embodiment. Accordingly, the heating resistor layer 2 is wider than each of the first strip-shaped portion 301 and the second strip-shaped portion 302.

Figure 19:
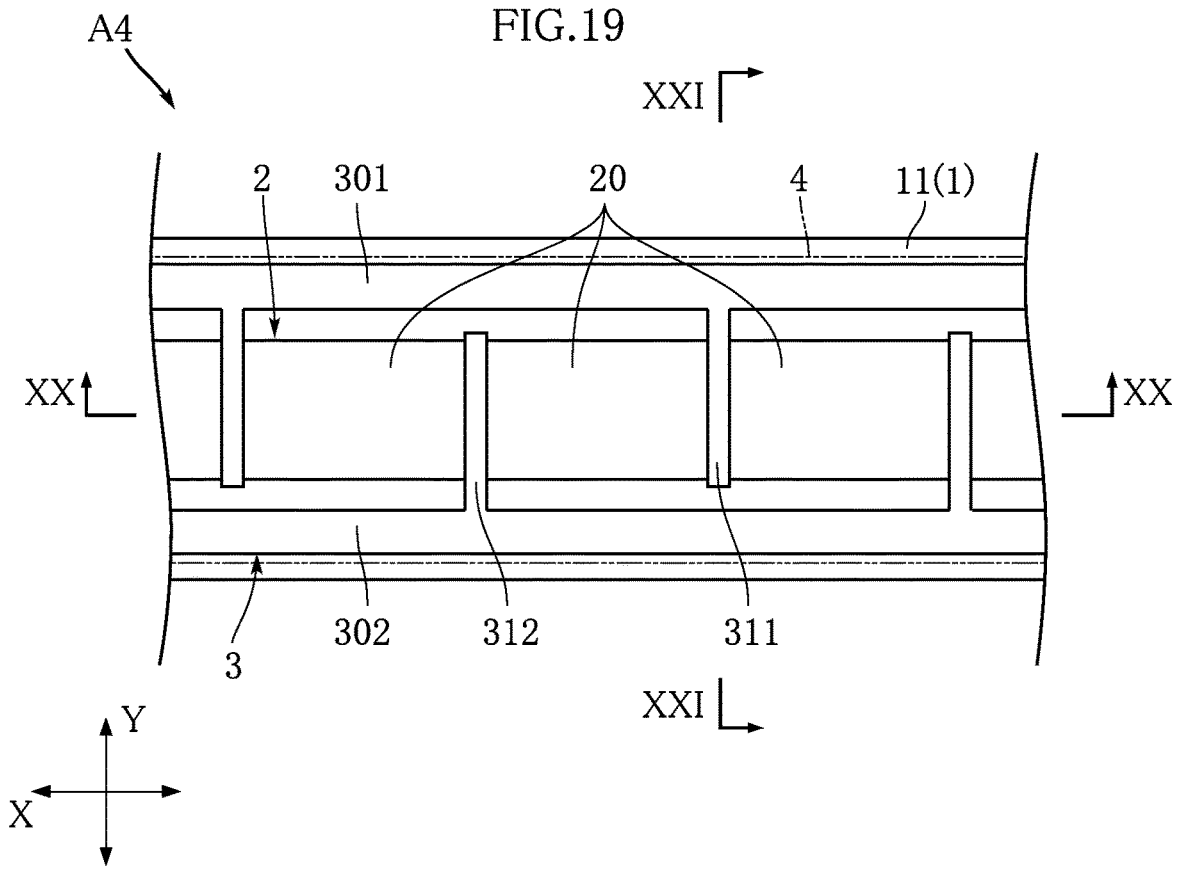
FIG. 19 is an enlarged fragmentary plan view of the heater shown in FIG. 17.

The plurality of first branch portions 311 are aligned in the longitudinal direction X with a spacing between each other, and each extend from the first strip-shaped portion 301 toward the second strip-shaped portion 302. In this embodiment, the first branch portions 311 each extend parallel to the width direction Y. In addition, as shown in FIG. 19, the first branch portions 311 each extend beyond the heating resistor layer 2 in the width direction Y, to a position close to the second strip-shaped portion 302. In other words, the first branch portions 311 each include a tip portion deviated from the heating resistor layer 2 as viewed in the thickness direction Z. The tip portion is located between the heating resistor layer 2 and the second strip-shaped portion 302, as viewed in the thickness direction Z.

The plurality of second branch portions 312 are aligned in the longitudinal direction X with a spacing between each other, and each extend from the second strip-shaped portion 302 toward the first strip-shaped portion 301. In this embodiment, the second branch portions 312 each extend parallel to the width direction Y. In addition, as shown in FIG. 19, the second branch portions 312 each extend beyond the heating resistor layer 2 in the width direction Y, to a position close to the first strip-shaped portion 301. In other words, the second branch portions 312 each include a tip portion deviated from the heating resistor layer 2 as viewed in the thickness direction Z. The tip portion is located between the heating resistor layer 2 and the first strip-shaped portion 301, as viewed in the thickness direction Z.

The plurality of first branch portions 311 and the plurality of second branch portions 312 are alternately aligned in the longitudinal direction X so as not to interfere with each other. In other words, one of the first branch portions 311 and one of the second branch portion 312 are located adjacent to each other with a spacing therebetween, in the longitudinal direction X.

In this embodiment, the heating resistor layer 2 is formed so as to intersect the plurality of first branch portions 311 and the plurality of second branch portions 312, in the longitudinal direction X. The heating resistor layer 2 includes a plurality of heating units 20, each of which is located between the first branch portion 311 and the second branch portion 312 adjacent to each other. The plurality of heating units 20 are aligned in a row in the longitudinal direction X. When power is supplied through the electrode layer 3, the plurality of heating units 20 are electrically connected to each other in parallel.

The distance between the first branch portion 311 and the second branch portion 312 in the longitudinal direction X (heating unit formation distance) may be, for example, 3 mm to 10 mm. In this embodiment, heating unit formation distance is approximately 5 mm, which is larger than the width of the heating resistor layer 2. In this embodiment, accordingly, the heating units 20 are each formed in a rectangular shape having the longer sides oriented in the longitudinal direction X.

The pair of pads 32 serve for electrical conduction with the printing apparatus 8. The pads 32 are spaced apart from the heating resistor layer 2, the first strip-shaped portion 301, and the second strip-shaped portion 302 in the longitudinal direction X. In this embodiment, the pads 32 are spaced apart from each other in the longitudinal direction X, with the heating resistor layer 2, the first strip-shaped portion 301, and the second strip-shaped portion 302 interposed therebetween.

The pair of connectors 33 each connect between one of the first strip-shaped portion 301 and the second strip-shaped portion 302, and one of the pads 32 corresponding thereto. In this embodiment, the connectors 33 each have a strip shape extending in the longitudinal direction X.

Figure 20:
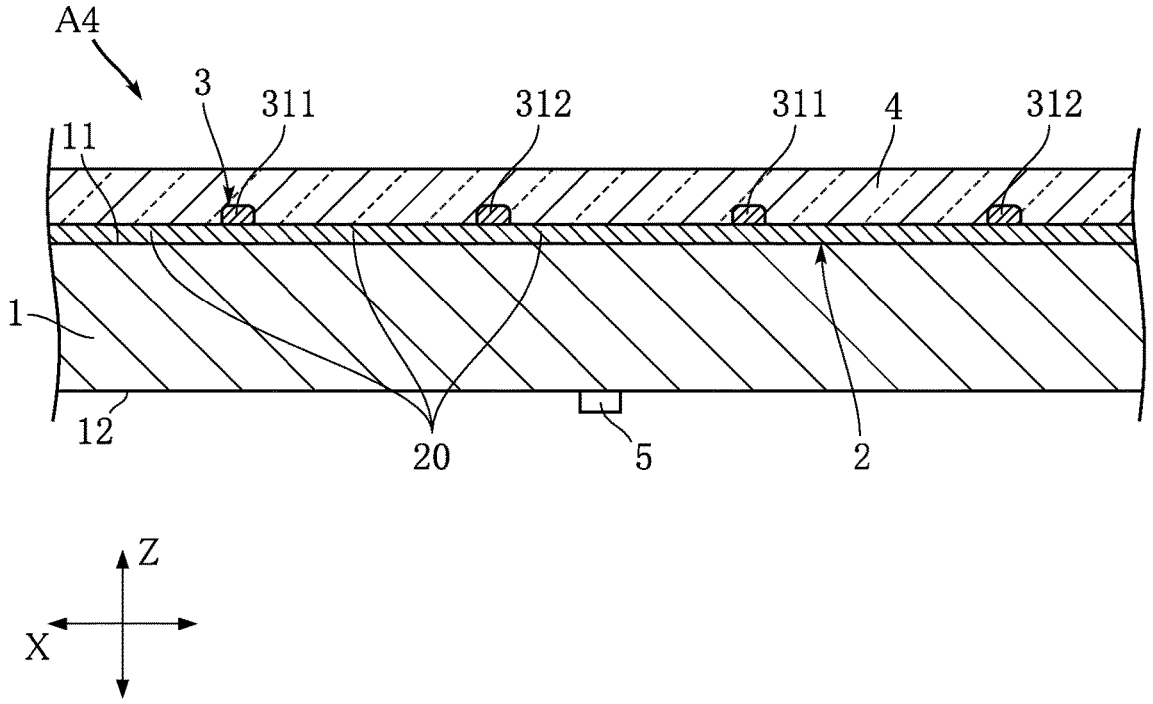
FIG. 20 is a cross-sectional view taken along a line XX-XX in FIG. 19.
Figure 21:
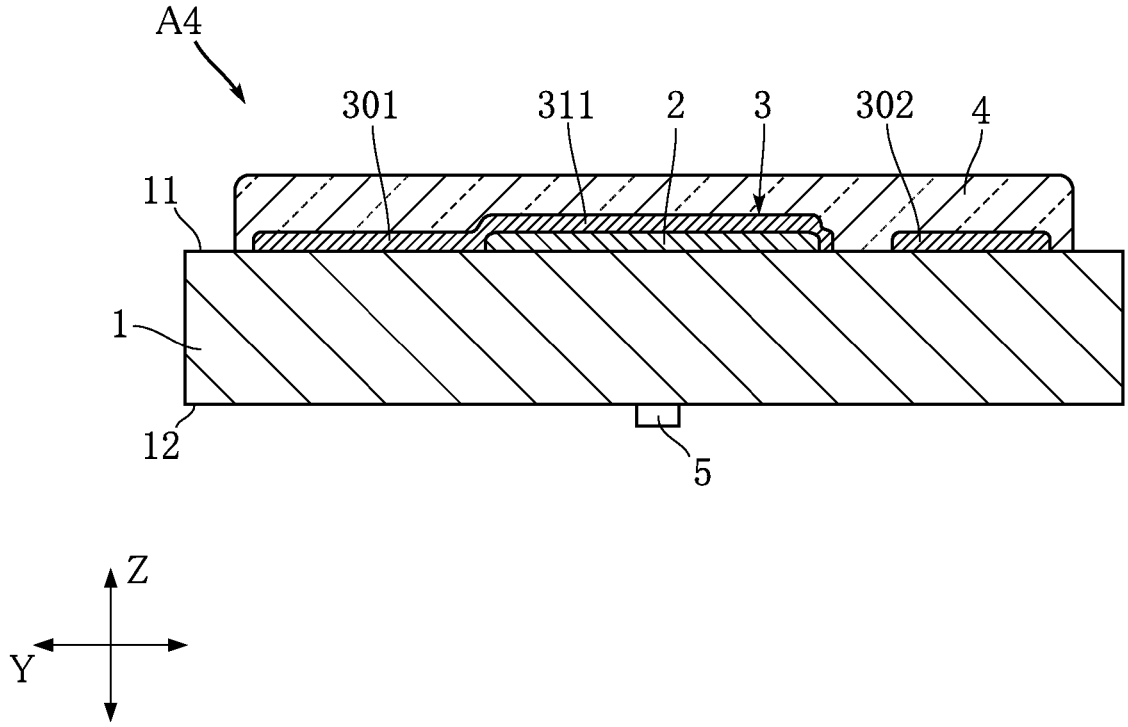
FIG. 21 is a cross-sectional view taken along a line XXI-XXI in FIG. 19.

As shown in FIG. 20 and FIG. 21, the entirety of the heating resistor layer 2 is formed directly on the obverse surface 11 in this embodiment. In addition, a portion of the electrode layer 3 overlapping the heating resistor layer 2 in a plan view (view in the thickness direction Z) is located on the heating resistor layer 2. The remaining portion of the electrode layer 3 deviated from the heating resistor layer 2 in a plan view is formed directly on the obverse surface 11. Alternatively, an insulation layer, for example made of glass, may be provided on the obverse surface 11, so as to be interposed between the obverse surface 11, and the heating resistor layer 2 and the electrode layer 3.

The protection layer 4 covers the entirety of the heating resistor layer 2. The protection layer 4 also covers the electrode layer 3 except for the pair of pads 32 and the periphery thereof (see FIG. 17). In other words, the protection layer 4 covers a part of the electrode layer 3. The protection layer 4 is made of glass for example, in a thickness of 40 μm to 100 μm. In this embodiment, the protection layer 4 has a thickness of approximately 60 μm. As is apparent from FIG. 21, the width of the protection layer 4 is narrower than that of the substrate 1. In this embodiment, the protection layer 4 includes a pair of edges (right edge and left edge in FIG. 21) spaced apart from each other in the width direction Y. Likewise, the substrate 1 includes a pair of edges (right edge and left edge in FIG. 21) spaced apart from each other in the width direction Y. In the width direction Y, the right edge of the protection layer 4 is inwardly shifted (toward the heating resistor layer 2) from the right edge of the substrate 1. Likewise, the left edge of the protection layer 4 is inwardly shifted (toward the heating resistor layer 2) from the left edge of the substrate 1.

The thermistor 5 serves as a sensor for detecting the temperature of the heater A4 when the heater A4 is activated. In this embodiment, the thermistor 5 is located on the reverse surface 12 of the substrate 1. The power to be supplied to the heater A1 is controlled according to the detection result of the thermistor 5.

Referring now to FIG. 22 to FIG. 25, a manufacturing method of the heater A4 will be described hereunder.

Figure 22:
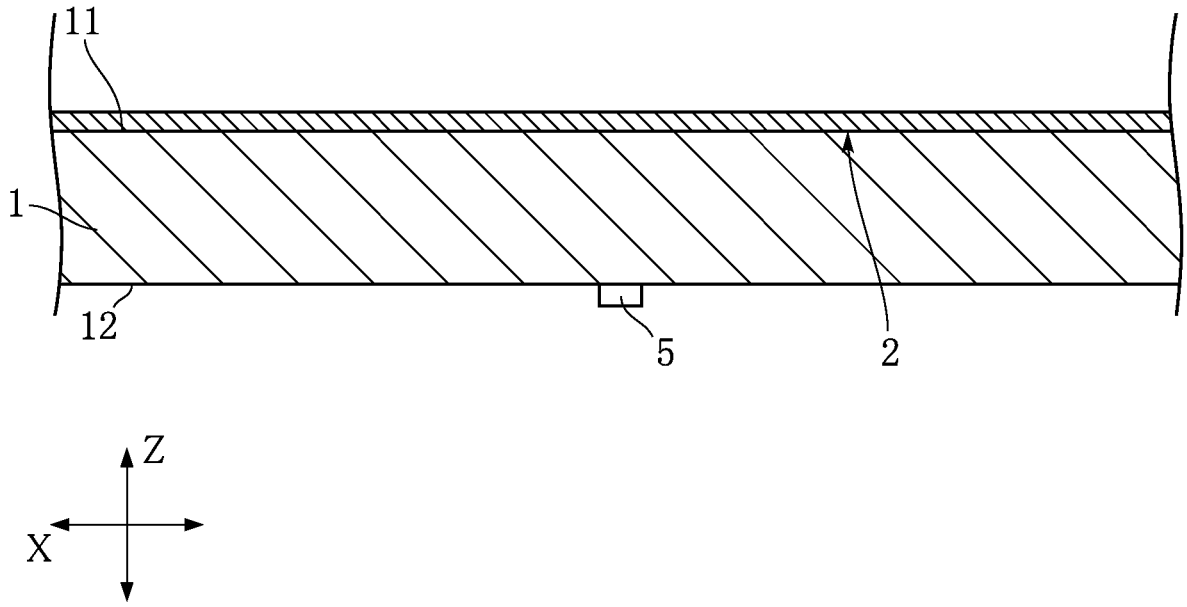
FIG. 22 is a cross-sectional view showing a process in a manufacturing method of the heater shown in FIG. 17.
Figure 23:
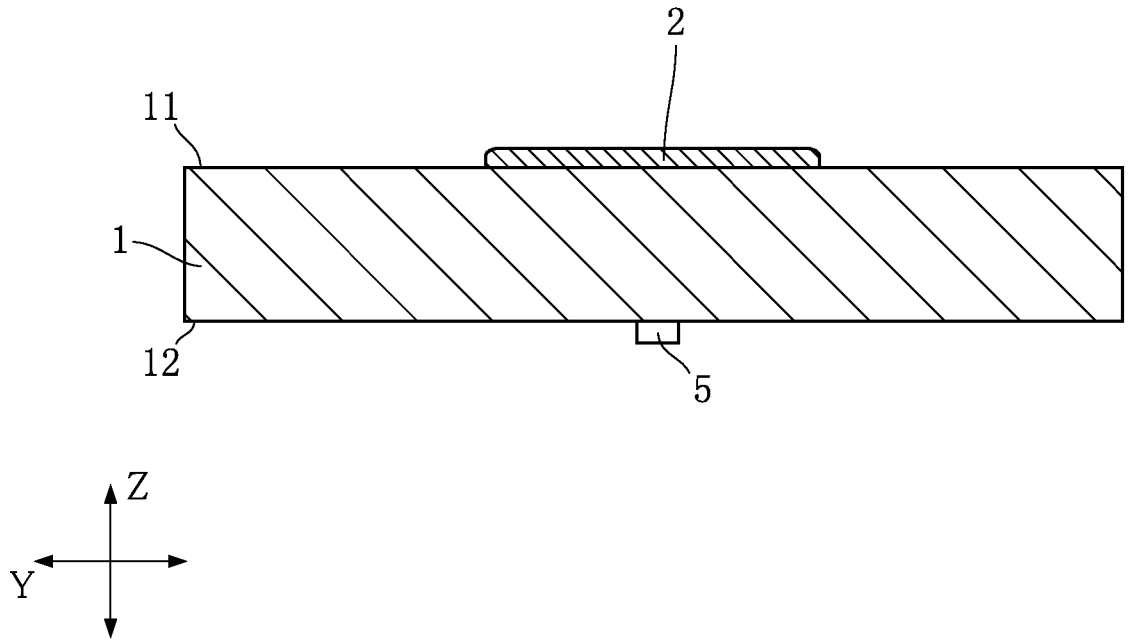
FIG. 23 is a cross-sectional view showing a process in the manufacturing method of the heater shown in FIG. 17.

Referring first to FIG. 22 and FIG. 23, the substrate 1 is prepared, and a conductive paste is printed on the obverse surface 11 in a strip shape extending in the longitudinal direction X. The conductive paste contains ruthenium oxide, for example. Upon sintering the printed conductive paste, the heating resistor layer 2 is obtained.

Figure 24:
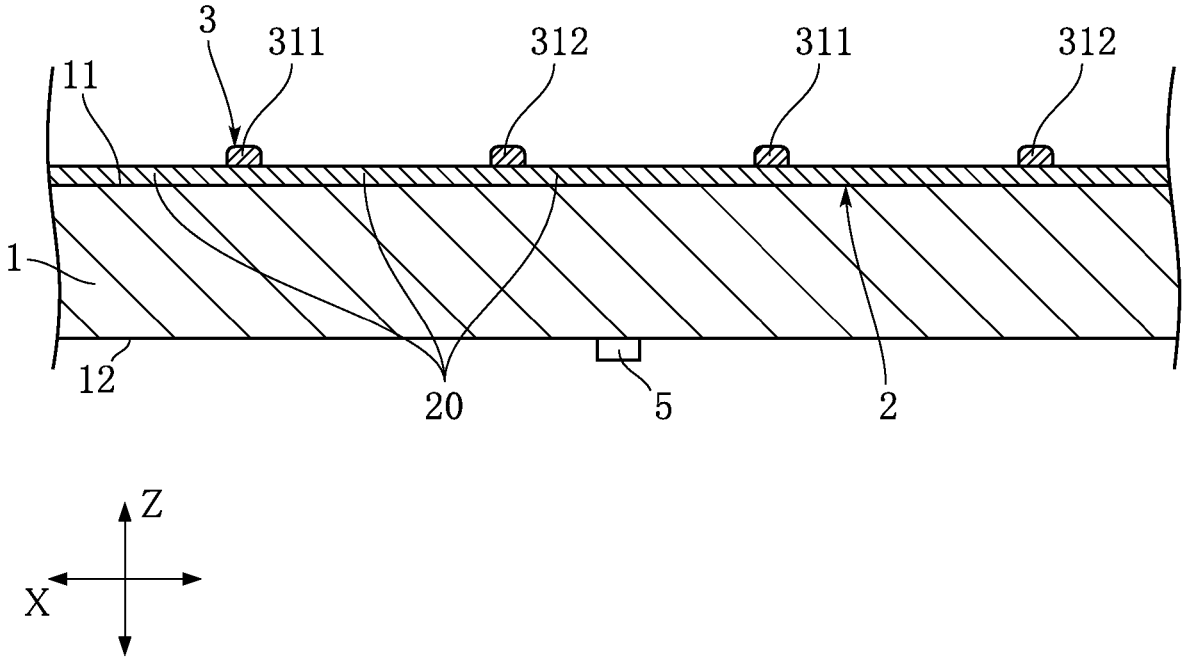
FIG. 24 is a cross-sectional view showing a process in the manufacturing method of the heater shown in FIG. 17.
Figure 25:
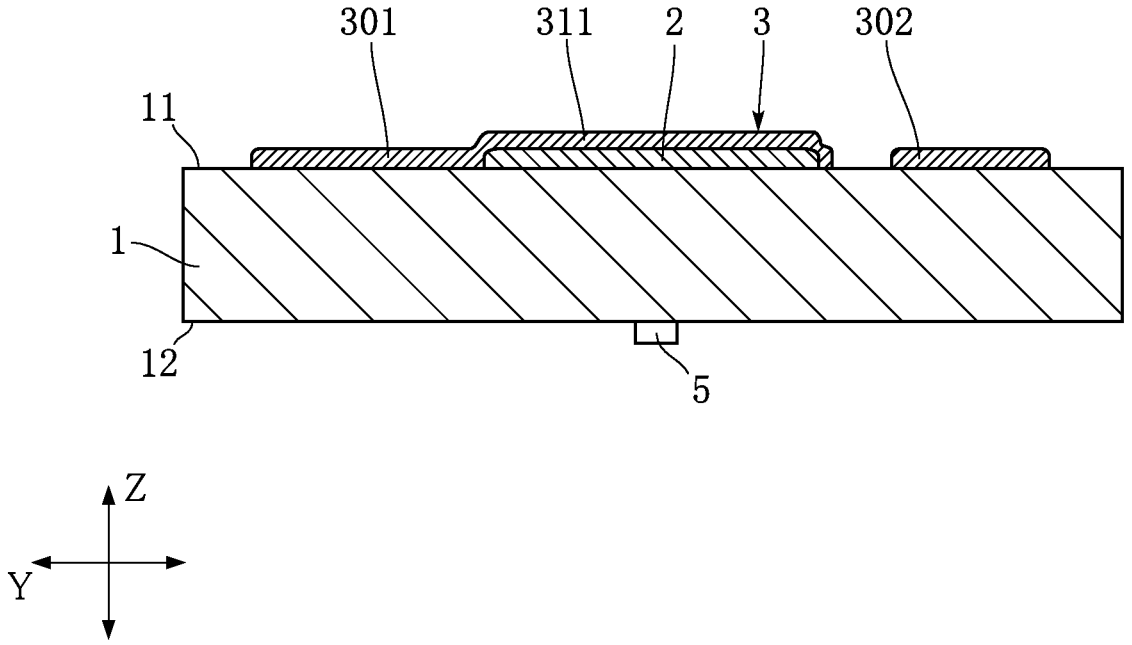
FIG. 25 is a cross-sectional view showing a process in the manufacturing method of the heater shown in FIG. 17.

Proceeding to FIG. 24 and FIG. 25, a conductive paste, for example containing Ag, is printed so as to form the electrode layer 3. In this process, the conductive paste is printed such that the plan-view shape accords with the shapes of the first strip-shaped portion 301, the second strip-shaped portion 302, the plurality of first branch portions 311, the plurality of second branch portions 312, the pair of pads 32, and the pair of connectors 33. Upon sintering the conductive paste thus printed, the electrode layer 3 is obtained.

The sintering process for forming the heating resistor layer 2 and the electrode layer 3 may be performed either separately or at a time. After the sintering process, the protection layer 4 is formed and the thermistor 5 is mounted, so that the heater A4 is obtained.

The heater A4 configured as above provides the following advantageous effects.

Figure 26:
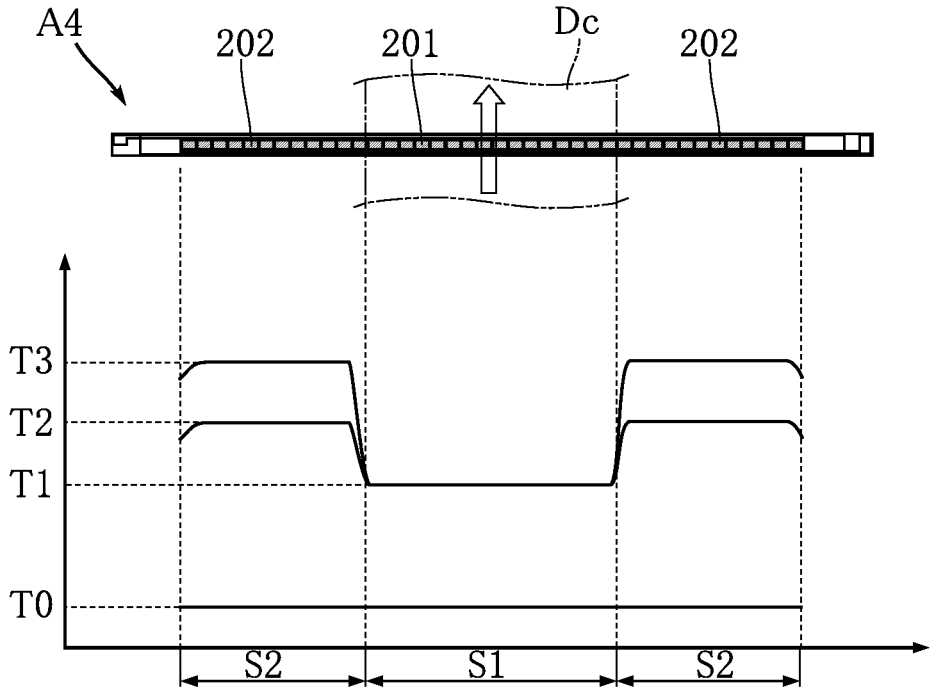
FIG. 26 includes a plan view showing an example of use of the heater shown in FIG. 17 and a temperature graph thereof.

FIG. 26 illustrates an example of use of the heater A4. FIG. 26 includes a plan view of the heater A4 in an upper portion, and the printing medium Dc is indicated by imaginary lines. The printing medium Dc is transported by the platen roller 81 (see FIG. 16) in the direction indicated by an arrow, in sliding contact with the heater A4. The example represents the case where the size of the printing medium Dc is relatively small with respect to the heater A4. For example, whereas the heater A4 is designed for a printing medium of A3 size, the printing medium Dc used herein is of A3 size. Referring to FIG. 26, a section of the heater A4 in the longitudinal direction where the printing medium Dc passes will be referred to as sheet passing section S1, and sections deviated from the printing medium Dc will be referred to as non-passing section S2.

When the power is not supplied, the plurality of heating units 20 of the heating resistor layer 2 do not generate heat, and hence the temperature of the heating units 20 is the reference temperature T0, for example. When the printing medium Dc starts to be transported and the power starts to be supplied, the heating units 20 generate heat. In the sheet passing section S1, the heat of the heating units 20 is transmitted to the printing medium Dc. In the non-passing section S2, in contrast, the heat of the heating units 20 is not transmitted to the printing medium Dc. Accordingly, the temperature of the heater A4 becomes relatively higher in the non-passing section S2, compared with the temperature in the sheet passing section S1.

Here, it will be assumed that, unlike in this embodiment, heater A4 is constituted of a single heating unit or member extending in the longitudinal direction X, and power is supplied exclusively through the both end portions of the heating unit in the longitudinal direction. It will also be assumed that the temperature of the sheet passing section S1 has reached a temperature T1 under a certain condition. With the mentioned heating unit, in this case the temperature in the non-passing section S2 excessively rises so as to reach the temperature T3. However, in this embodiment the heating resistor layer 2 includes the plurality of heating units 20 defined by the plurality of branch portions. In addition, the heating resistor layer 2 (in particular, the heating units 20) has a temperature coefficient of resistance between 1500 ppm/° C. to 5000 ppm/° C. (e.g., approximately 2000 ppm/° C.). Accordingly, with the increase of the temperature of the non-passing section S2 from the temperature T1, the sheet resistance of the heating units 20 located in the non-passing region 202 becomes higher than the sheet resistance of the heating units 20 located in the sheet passing region 201. Therefore, the current flowing from the electrode layer 3 toward the heating resistor layer 2 circumvents the non-passing region 202 so as to concentrate in the sheet passing region 201. As a result, the calorific value in the non-passing region 202 is suppressed, and therefore the temperature in the non-passing section S2 becomes T2 which is lower than T3. Thus, with the configuration according to this embodiment, the temperature in the non-passing section S2 can be prevented from excessively rising, compared with the temperature in the sheet passing section S1.

In this embodiment, the current flowing through each of the heating units 20 mainly flows along the longitudinal direction X. Accordingly, the resistance of the heating unit 20 can be increased, and hence a sufficient calorific value can be secured, by increasing the interval between the first branch portion 311 and the second branch portion 312 adjacent to each other. In addition, reducing the width of the heating unit 20 leads to an increase in resistance thereof. Thus, the finer and the more elongate the heating resistor layer 2 is made, the higher calorific value can be obtained. Further, when heat is intensely generated along the fine heating resistor layer 2, the heat can be more efficiently transmitted to the printing medium Dc which is pressed against the platen roller 81 having a circular cross-section.

In this embodiment, the pair of pads 32 are spaced apart from each other in the longitudinal direction X. Accordingly, the conduction paths extending from pair of pads 32 so as to pass the heating units 20 have a uniform length, with respect to the plurality of heating units 20. Such a configuration contributes to suppressing uneven heat generation along the longitudinal direction X.

In this embodiment, the respective tip portions of the first branch portions 311 and the second branch portions 312 protrude from the heating resistor layer 2. In other words, the first branch portions 311 and the second branch portions 312 completely intersect the heating resistor layer 2 in the width direction Y. Such a configuration contributes to securing a uniform calorific value from each of the heating units 20. Alternatively, the tip portions of the first branch portions 311 and the second branch portions 312 may be aligned with the edge of the heating resistor layer 2.

FIG. 27 to FIG. 30 illustrate a variation of the fourth embodiment and some other embodiments. In these drawings, the elements same as or similar to those of the fourth embodiment are denoted by the same numeral.

Figure 27:
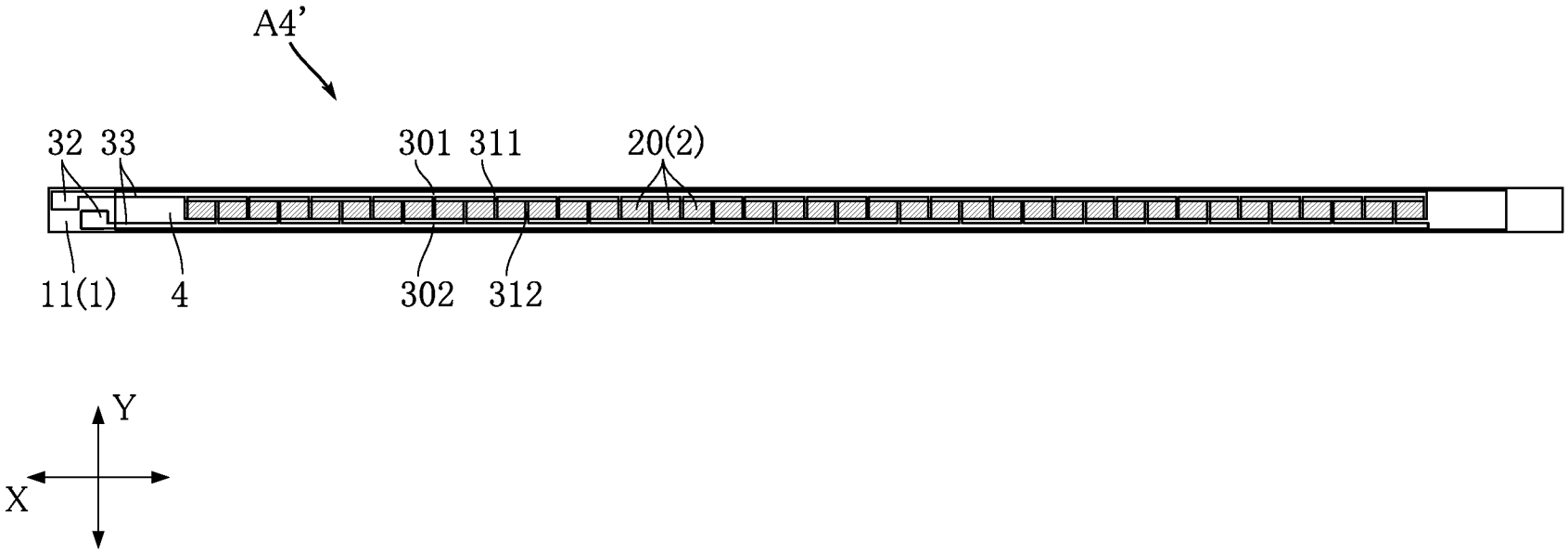
FIG. 27 is a plan view showing a variation of the heater shown in FIG. 17.

FIG. 27 illustrates the variation of the heater A4. In the heater A4' illustrated therein, the pair of pads 32 are located on the same side of the heating resistor layer 2, in the longitudinal direction X. Such a configuration also suppresses the temperature rise in the non-passing section S2. As is understood from this variation, the position of the pair of pads 32 may be arranged as desired. For example, the pads 32 may be provided on the reverse surface 12. Such a variation of the pair of pads 32 is equally applicable to other embodiments to be subsequently described.

Figure 28:
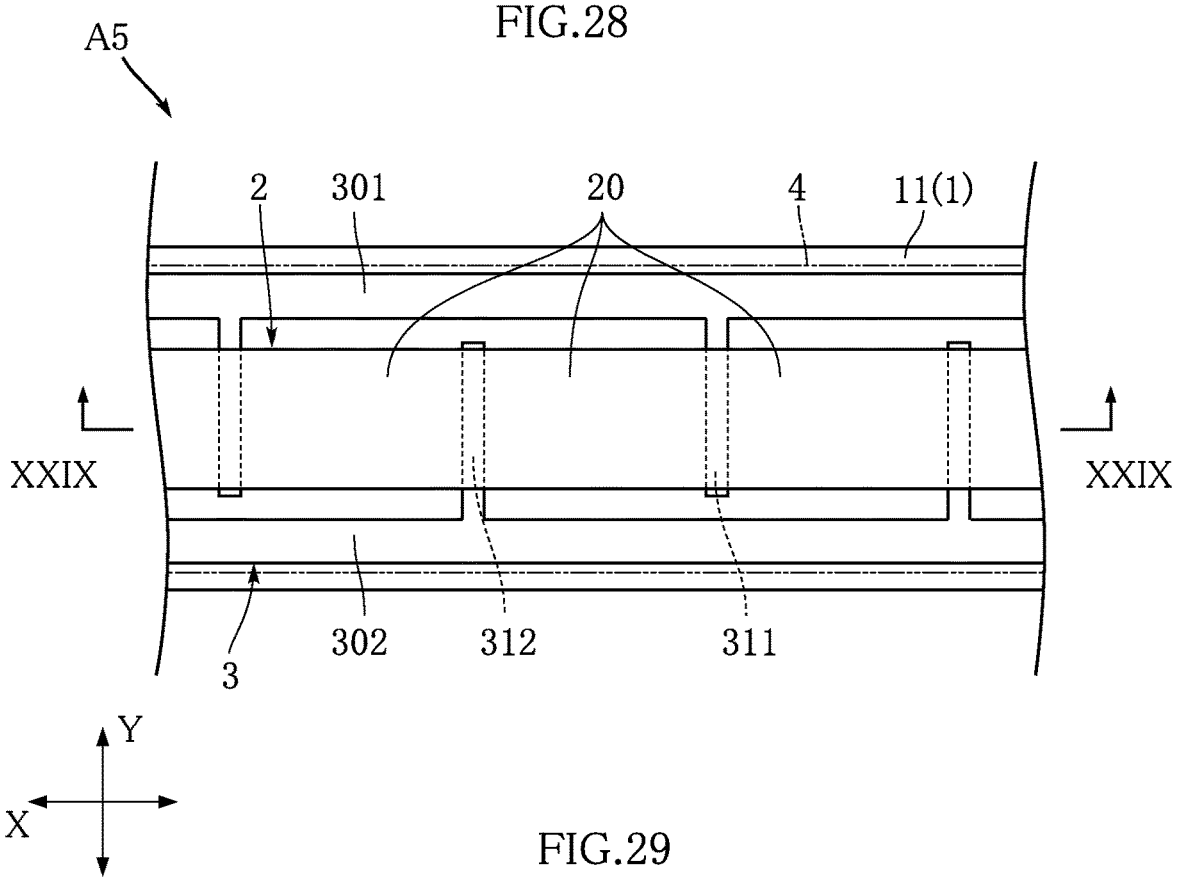
FIG. 28 is a fragmentary cross-sectional view of a heater according to a fifth embodiment of the present invention.
Figure 29:
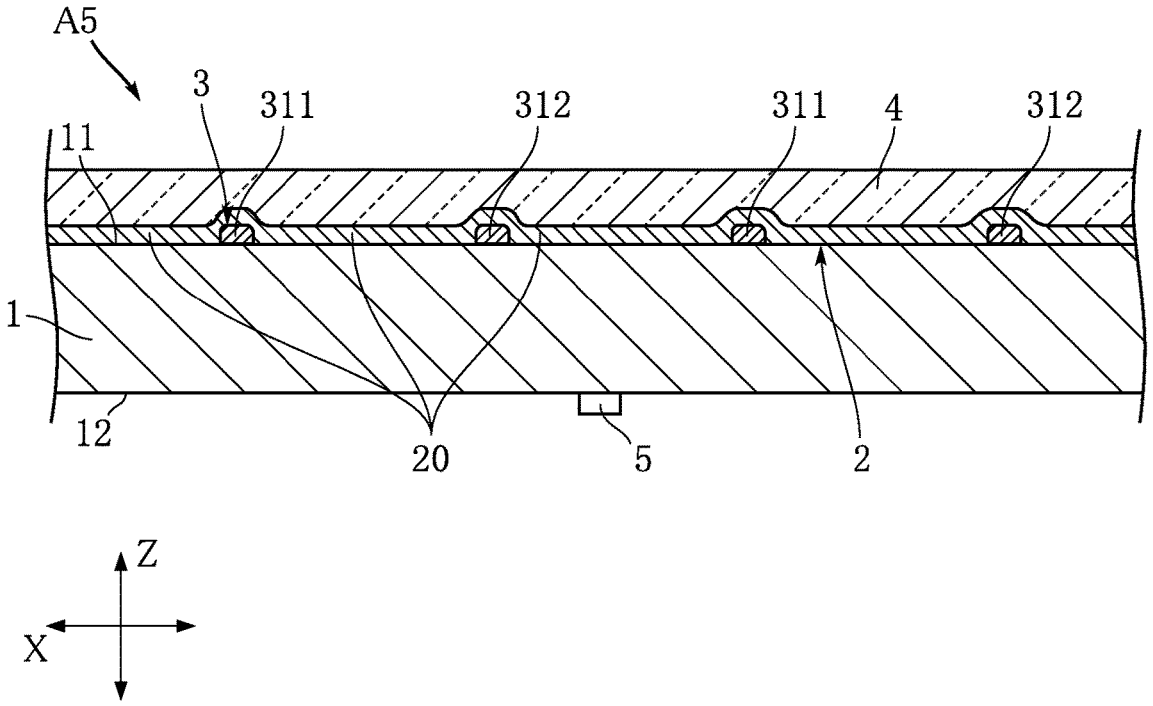
FIG. 29 is a cross-sectional view taken along a line XXIX-XXIX in FIG. 28.

FIG. 28 and FIG. 29 illustrate a heater according to a fifth embodiment of the present invention. The heater A5 according to this embodiment is different from the heater A4 in the configuration of the heating resistor layer 2 and the electrode layer 3.

In the heater A5, the entirety of the electrode layer 3 is formed directly on the obverse surface 11. Therefore, apart of the heating resistor layer 2 (portions overlapping the plurality of first branch portions 311 and the plurality of second branch portions 312 in a plan view) is formed over the branch portions 311 and 312. In contrast, the remaining portions of the heating resistor layer 2 deviated from the branch portions 311 and 312 are formed directly on the obverse surface 11 (see FIG. 29).

In the heater A5 also, the sheet resistance of the non-passing region 202 (see FIG. 26) is higher than that of the sheet passing region 201. Accordingly, the current from the electrode layer 3 tends to concentrate in the sheet passing section S1, and therefore the excessive temperature rise in the non-passing section S2 can be suppressed.

Figure 30:
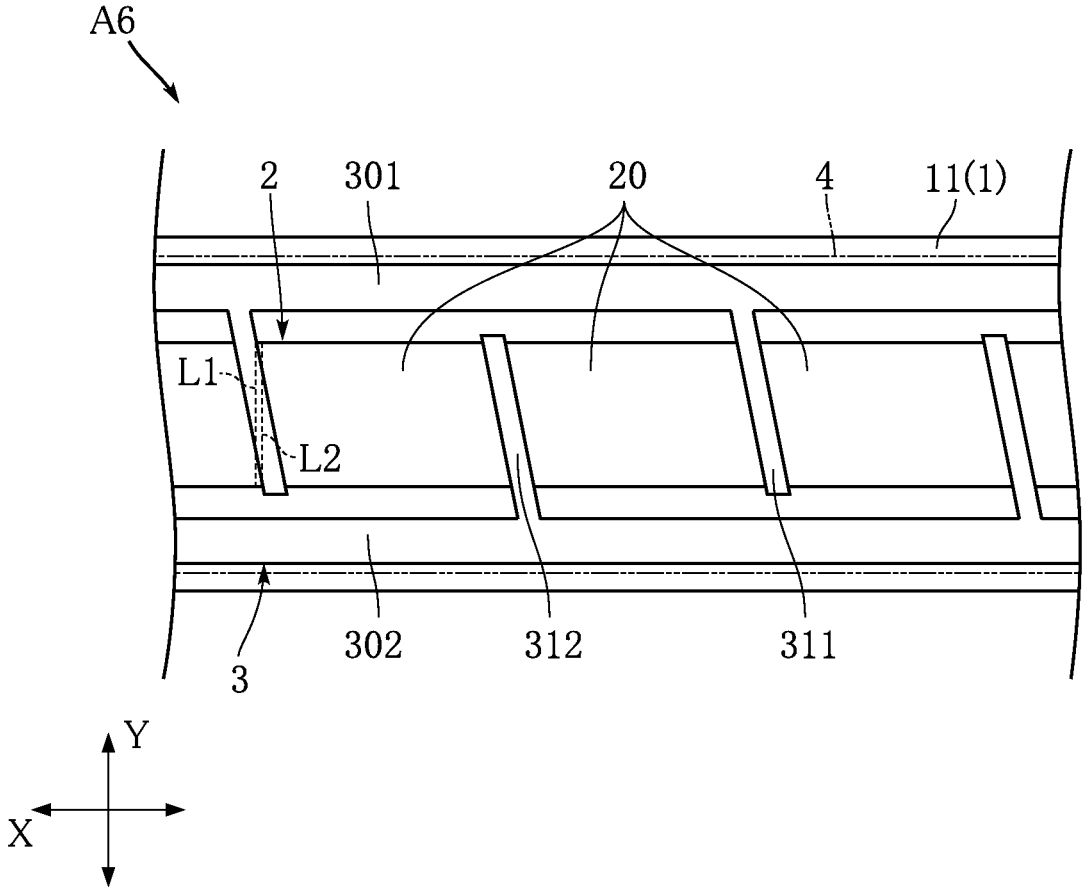
FIG. 30 is a fragmentary cross-sectional view of a heater according to a sixth embodiment of the present invention.

FIG. 30 illustrates a heater according to a sixth embodiment of the present invention. The heater A6 according to this embodiment is different from the heater A4 or A5 in the configuration of the plurality of first branch portions 311 and the plurality of second branch portions 312.

In the heater A6, the first branch portions 311 and the second branch portions 312 are each inclined with respect to the width direction Y. The first branch portions 311 are parallel to each other, and so are the second branch portions 312. In addition, the first branch portions 311 and the second branch portions 312 are parallel to each other.

The inclination angle of the first branch portions 311 with respect to the width direction Y is determined as follows. On the respective sides of the first branch portion 311, two heating units 20 adjacent to each other are located. The inclination angle of the first branch portion 311 is determined such that the two heating units 20 partially overlap as viewed in the width direction Y. In this case, regarding two straight lines L1 and L2 extending in the width direction Y, the straight line L1 is located on the left of the straight line L2, as shown in FIG. 30. In FIG. 30, the straight line L1 extends in the width direction Y through the intersection between the right edge of the first branch portion 311 and the upper edge of the heating resistor layer 2 (edge close to the first strip-shaped portion 301). The straight line L2 extends in the width direction Y through the intersection between the left edge of the first branch portion 311 and the lower edge of the heating resistor layer 2 (edge close to the second strip-shaped portion 302). The inclination of the first branch portion 311 is equally applied to the second branch portion 312.

In the heater A6 also, the sheet resistance of the non-passing region 202 (see FIG. 26) is higher than that of the sheet passing region 201. Accordingly, the current from the electrode layer 3 tends to concentrate in the sheet passing section S1, and therefore the excessive temperature rise in the non-passing section S2 can be suppressed.

Further, as described above, in the heater A6 the plurality of first branch portions 311 and the plurality of second branch portions 312 are inclined with respect to the width direction Y. Such a configuration eliminates the likelihood that a part of the printing medium Dc is only opposed to the first branch portion 311 or the second branch portion 312 (i.e., not opposed to the heating unit 20 at all) while being transported in the width direction Y. Thus, a drawback in that a portion of the printing medium Dc to be heated is left unheated can be prevented.

The inclination angle of the plurality of first branch portions 311 may be different from one another. Likewise, the inclination angle of the plurality of second branch portions 312 may be different from one another. In addition, the inclination angle of the first branch portions 311 and the inclination angle of the second branch portions 312 may be different from each other.

The heater of the present invention is in no way limited to the foregoing embodiments. Specific configurations of the elements of the heater of the present invention may be modified in various manners within the scope of the present invention.

The configuration of the second aspect of the embodiments of the present invention, as well as the variations thereof, may be itemized as the following appendices.

[Appendix 1]

A heater including:

an elongate substrate having a substrate obverse surface and a substrate reverse surface;

a heating resistor layer formed on the substrate obverse surface; and an electrode layer formed on the substrate obverse surface and in contact with the heating resistor layer, wherein the electrode layer includes: a first strip-shaped portion and a second strip-shaped portion each extending in a longitudinal direction of the substrate and spaced apart from each other in the width direction of the substrate; a plurality of first branch portions extending from the first strip-shaped portion toward the second strip-shaped portion; and a plurality of second branch portions extending from the second strip-shaped portion toward the first strip-shaped portion, the plurality of first branch portions and the plurality of second branch portions are alternately aligned in the longitudinal direction, the heating resistor layer includes a plurality of heating units, each of which is located in contact with the first branch portion and the second branch portion adjacent to each other.

[Appendix 2]

The heater according to Appendix 1, wherein the heating resistor layer has an elongate strip shape extending in the longitudinal direction as a whole, so as to intersect the plurality of first branch portions and the plurality of second branch portions.

[Appendix 3]

The heater according to Appendix 2, wherein respective tip portions of the first branch portions protrude from the heating resistor layer toward the second strip-shaped portion.

[Appendix 4]

The heater according to Appendix 3, wherein respective tip portions of the second branch portions protrude from the heating resistor layer toward the first strip-shaped portion.

[Appendix 5]

The heater according to any one of Appendices 2 to 4, wherein the plurality of first branch portions are parallel to the width direction.

[Appendix 6]

The heater according to Appendix 5, wherein the plurality of second branch portions are parallel to the width direction.

[Appendix 7]

The heater according to any one of Appendices 2 to 4, wherein the plurality of first branch portions are inclined with respect to the width direction.

[Appendix 8]

The heater according to Appendix 7, wherein the plurality of second branch portions are inclined with respect to the width direction.

[Appendix 9]

The heater according to Appendix 8, wherein two heating units adjacent to each other via one of the first branch portions partially overlap with each other as viewed in the width direction.

[Appendix 10]

The heater according to Appendix 9, wherein two heating units adjacent to each other via one of the second branch portions partially overlap with each other as viewed in the width direction.

[Appendix 11]

The heater according to any one of Appendices 2 to 10, wherein a distance between the first branch portion and the second branch portion adjacent to each other in the longitudinal direction is longer than a size of the heating resistor layer in the width direction.

[Appendix 12]

The heater according to any one of Appendices 2 to 11, wherein a distance between the first strip-shaped portion and the heating resistor layer in the width direction is shorter than the size of the heating resistor layer in the width direction.

[Appendix 13]

The heater according to Appendix 12, wherein a distance between the second strip-shaped portion and the heating resistor layer in the width direction is shorter than the size of the heating resistor layer in the width direction.

[Appendix 14]

The heater according to any one of Appendices 2 to 13, wherein a size of the first strip-shaped portion in the width direction is smaller than the size of the heating resistor layer in the width direction.

[Appendix 15]

The heater according to Appendix 14, wherein a size of the second strip-shaped portion in the width direction is smaller than the size of the heating resistor layer in the width direction.

[Appendix 16]

The heater according to any one of Appendices 2 to 15, wherein at least a part of the first branch portion and of the second branch portion is formed on the heating resistor layer.

[Appendix 17]

The heater according to Appendix 16, wherein the heating resistor layer is formed directly on the substrate obverse surface.

[Appendix 18]

The heater according to Appendix 17, wherein a portion of the electrode layer deviated from the heating resistor layer is formed directly on the substrate obverse surface.

[Appendix 19]

The heater according to any one of Appendices 1 to 18, wherein the heating resistor layer contains ruthenium oxide.

[Appendix 20]

The heater according to Appendix 19, wherein the heating resistor layer contains copper oxide.

[Appendix 21]

The heater according to any one of Appendices 1 to 20, further including a protection layer covering at least a part of each of the heating resistor layer and the electrode layer.

[Appendix 22]

The heater according to Appendix 21, wherein the protection layer is made of glass.

[Appendix 23]

The heater according to Appendix 21 or 22, wherein the protection layer covers an entirety of the heating resistor layer.

[Appendix 24]

The heater according to any one of Appendices 21 to 23, wherein the electrode layer includes a pair of pads respectively connected to the first strip-shaped portion and the second strip-shaped portion, and the pair of pads are exposed from the protection layer.

[Appendix 25]

The heater according to Appendix 24, wherein the pair of pads are spaced apart from each other in the longitudinal direction, with the first strip-shaped portion and the second strip-shaped portion interposed therebetween.

[Appendix 26]

The heater according to Appendix 24, wherein the pair of pads are located on the same side of the first strip-shaped portion and the second strip-shaped portion, in the longitudinal direction.

[Appendix 27]

The heater according to any one of Appendices 1 to 26, further including a thermistor provided on the substrate reverse surface.

[Appendix 28]

The heater according to any one of Appendices 1 to 27, wherein the substrate is made of a ceramic.

[Appendix 29]

The heater according to Appendix 28, wherein the ceramic includes alumina or aluminum nitride.

[Appendix 30]

The heater according to Appendix 28 or 29, wherein the substrate has a thickness of 0.4 to 1.2 mm.

[Appendix 31]

The heater according to any one of Appendices 1 to 29, wherein the electrode layer contains Ag.

[Appendix 32]

The heater according to any one of Appendices 1 to 31, wherein the heating resistor layer has a temperature coefficient of resistance of 1500 ppm/° C. to 5000 ppm/° C.

[Appendix 33]

The heater according to Appendix 32, wherein the heating resistor layer has a sheet resistance of 10 Ω/sq to 2000 Ω/sq, at a reference temperature.

[Appendix 34]

The heater according to any one of Appendices 1 to 33, wherein the heating resistor layer has a size of 290 mm to 310 mm in the longitudinal direction.

In the configuration according to the foregoing Appendices, as shown in FIG. 19 for example, the electrode layer 3 includes: the first strip-shaped portion 301 and the second strip-shaped portion 302 each extending in the longitudinal direction X of the substrate 1 and spaced apart from each other in the width direction of the substrate 1; the plurality of first branch portions 311 extending from the first strip-shaped portion 301 toward the second strip-shaped portion 302; and the plurality of second branch portions 312 extending from the second strip-shaped portion 302 toward the first strip-shaped portion 301. The plurality of first branch portions 311 and the plurality of second branch portions 312 are alternately aligned in the longitudinal direction X. The heating resistor layer 2 includes the plurality of heating units 20, each of which is located in contact with the first branch portion 311 and the second branch portion 312 adjacent to each other. The mentioned configuration provides a heater capable of suppressing, when heating a relatively narrow printing medium, an excessive temperature rise on both sides of the printing medium in the width direction.

The invention claimed is:

1. A heater comprising:

an elongate substrate having a substrate obverse surface and a substrate reverse surface;

a heating resistor layer formed on the substrate obverse surface; and an electrode layer formed on the substrate obverse surface and in contact with the heating resistor layer, wherein the electrode layer includes a first strip-shaped portion and a second strip-shaped portion extending in a longitudinal direction of the substrate and spaced apart from each other in a width direction of the substrate, the heating resistor layer includes at least a first main heating member and a first sub heating member, each extending in the longitudinal direction and located between the first strip-shaped portion and the second strip-shaped portion in the width direction, the first sub heating member has a higher temperature coefficient of resistance than a temperature coefficient of resistance of the first main heating member, and the first main heating member and the first sub heating member overlap with each other as viewed in the width direction, and also are in partial contact with each other in the width direction.

2. The heater according to claim 1, wherein the first main heating member has a resistance in the width direction that is higher at a reference temperature than a resistance of the first sub heating member in the width direction.

3. The heater according to claim 2, wherein the first main heating member has a sheet resistance that is higher at the reference temperature than a sheet resistance of the first sub heating member.

4. The heater according to claim 1, wherein the heating resistor layer further includes a second sub heating member, and the first main heating member is located between the first sub heating member and the second sub heating member in the width direction.

5. The heater according to claim 4, wherein the first sub heating member and the second strip-shaped portion each have a first end portion and a second end portion spaced apart from each other in the width direction, and the first end portion of the first sub heating member is located on the first strip-shaped portion, and the first end portion of the second sub heating member is located on the second strip-shaped portion.

6. The heater according to claim 5, wherein the second end portion of the first sub heating member and the second end portion of the second sub heating member are located on the first main heating member.

7. The heater according to claim 1, wherein the heating resistor layer further includes a second main heating member, and the first sub heating member is located between the first main heating member and the second main heating member in the width direction.

8. The heater according to claim 7, wherein the first main heating member and the second main heating member each include a first end portion and a second end portion spaced apart from each other in the width direction, and the first end portion of the first main heating member is located on the first strip-shaped portion, and the first end portion of the second main heating member is located on the second strip-shaped portion.

9. The heater according to claim 8, wherein the second end portion of the first main heating member and the second end portion of the second main heating member are located on the first sub heating member.

10. The heater according to claim 1, wherein the first main heating member includes an end portion located on the first strip-shaped portion.

11. The heater according to claim 10, wherein the first sub heating member includes an end portion located on the second strip-shaped portion.

12. The heater according to claim 1, wherein the first main heating member is smaller in size in the width direction than each of the first strip-shaped portion and the second strip-shaped portion.

13. The heater according to claim 12, wherein the first sub heating member is smaller in size in the width direction than each of the first strip-shaped portion and the second strip-shaped portion.

14. The heater according to claim 13, wherein the heating resistor layer is greater in size in the width direction than the first strip-shaped portion and the second strip-shaped portion.

15. The heater according to claim 1, wherein the electrode layer is formed directly on the substrate obverse surface.

16. The heater according to claim 1, wherein the heating resistor layer is formed directly on the substrate obverse surface.

17. The heater according to claim 1, wherein the heating resistor layer contains ruthenium oxide.

18. The heater according to claim 17, wherein the heating resistor layer contains copper oxide.

19. The heater according to claim 1, further comprising a protection layer that at least partially covers the heating resistor layer and the electrode layer.

20. The heater according to claim 19, wherein the protection layer is made of glass.

21. The heater according to claim 20, wherein the protection layer covers an entirety of the heating resistor layer.

22. The heater according to claim 21, wherein the electrode layer includes a first pad and a second pad that are connected to the first strip-shaped portion and the second strip-shaped portion, respectively, and the first pad and the second pad are exposed from the protection layer.

23. The heater according to claim 22, wherein the first pad and the second pad are spaced apart from each other in the longitudinal direction, with the first strip-shaped portion and the second strip-shaped portion interposed therebetween.

24. The heater according to claim 22, wherein the first pad and the second pad are located on a same side of the first strip-shaped portion and the second strip-shaped portion in the longitudinal direction.

25. The heater according to claim 1, further comprising a thermistor provided on the substrate reverse surface.

26. The heater according to claim 1, wherein the substrate is made of a ceramic.

27. The heater according to claim 26, wherein the ceramic comprises alumina or aluminum nitride.

28. The heater according to claim 26, wherein the substrate has a thickness of 0.4 to 1.2 mm.

29. The heater according to claim 1, wherein the electrode layer contains Ag.

30. The heater according to claim 1, wherein a temperature coefficient of resistance of the first sub heating member is not smaller than three times and not greater than fifteen times a temperature coefficient of resistance of the first main heating member.

31. The heater according to claim 1, wherein the first main heating member and the first sub heating member each have a size of 290 mm to 310 mm in the longitudinal direction.

* * * * *